US008616263B2

(12) United States Patent
Hadano et al.

(10) Patent No.: US 8,616,263 B2
(45) Date of Patent: Dec. 31, 2013

(54) MOLDING MACHINE AND MOLDING PROCESS

(75) Inventors: Yutaka Hadano, Toyokawa (JP); Takayuki Komiyama, Toyokawa (JP); Shuji Takasu, Toyokawa (JP); Shuichi Ide, Toyokawa (JP); Takuya Nitta, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

(21) Appl. No.: 13/514,424

(22) PCT Filed: Jul. 20, 2010

(86) PCT No.: PCT/JP2010/062163

§ 371 (c)(1),
(2), (4) Date: Jun. 7, 2012

(87) PCT Pub. No.: WO2011/070814

PCT Pub. Date: Jun. 16, 2011

(65) Prior Publication Data

US 2012/0241117 A1 Sep. 27, 2012

(30) Foreign Application Priority Data

Jun. 15, 2010 (JP) ..... 2010-135821

(51) Int. Cl.
*B22C 15/02* (2006.01)
*B22C 15/08* (2006.01)

(52) U.S. Cl.
USPC ..... 164/20; 164/201

(58) Field of Classification Search
USPC ..... 164/20–22, 37, 38, 169, 172, 173, 194, 164/195, 200–202
See application file for complete search history.

(56) References Cited

U.S. PATENT DOCUMENTS 4,836,266 A * 6/1989 Wuepper et al. ..... 164/29
4,890,664 A * 1/1990 Hunter ..... 164/182

(Continued)

FOREIGN PATENT DOCUMENTS

JP 43-2181 1/1943
JP 59-024552 2/1984

(Continued)

OTHER PUBLICATIONS

USPTO translation of JP 03-114312 U, Feb. 2013.*

(Continued)

*Primary Examiner* — Kevin P Kerns
*Assistant Examiner* — Kevin E Yoon
(74) *Attorney, Agent, or Firm* — Finnegan, Henderson, Farabow, Garrett & Dunner, L.L.P.

(57) ABSTRACT

Disclosed is a molding machine for simultaneously making upper and lower molds with cope and drag flasks, a matchplate, upper and lower squeezing boards, and a lower filling frame. This machine also includes a cylinder for raising and lowering the lower squeezing board, a driving mechanism that includes pneumatic and hydraulic piping systems for driving the cylinder using an air-on-oil system, and a controller for controlling the driving mechanism. The drag flask, the matchplate, the filling frame, and the lower board define a lower molding space, while the matchplate, the upper board, and the cope flask define an upper molding space such that the controller controls the driving mechanism to drive the cylinder at a low pressure. The lower squeezing board is raised to squeeze the molding sand for simultaneously making the two molds such that the controller controls the driving mechanism to drive the cylinder at a high pressure.

14 Claims, 18 Drawing Sheets

(56) References Cited

U.S. PATENT DOCUMENTS

| | | | | |
|---|---|---|---|---|
| 7,237,593 | B2 * | 7/2007 | Kaneto et al. | 164/37 |
| 2009/0145573 | A1 * | 6/2009 | Hirata et al. | 164/180 |

FOREIGN PATENT DOCUMENTS

| | | |
|---|---|---|
| JP | 3-114312 | 11/1991 |
| JP | 2005-144544 | 6/2005 |

OTHER PUBLICATIONS

USPTO translation of JP 43-002181 B, Mar. 2013.*
International Search Report dated Oct. 12, 2010 issued in International Application No. PCT/JP2010/062163.

* cited by examiner

MOLDING MACHINE AND MOLDING PROCESS

CROSS-REFERENCES TO RELATED APPLICATIONS

This application claims the benefits of Japanese Patent Application Nos. 2009-278,252, filed Dec. 8, 2009, 2010-103,806, filed Apr. 28, 2010, and 2010-135,821, filed Jun. 15, 2010. All their disclosures are incorporated herein by reference.

TECHNICAL FIELD

The present invention relates to a molding machine and a molding process for making molds. In particular, the present invention relates to a molding machine and a molding process for simultaneously making an upper mold and a lower mold by using, instead of a hydraulic pump, a booster cylinder for transforming pneumatic pressure to hydraulic high-pressure to be used to define molding spaces and to squeeze molding sand.

BACKGROUND

Conventionally, both a molding machine and a molding process for simultaneously making an upper mold and a lower mold are well known. Both carry out the steps for defining a lower molding space by a lower squeezing board and a filling frame, introducing molding sand in an upper molding space and the lower molding space at the same time from a blow tank, lifting the lower squeezing board to simultaneously make an upper mold and a lower mold, removing them from a pattern plate, and removing the upper mold and the lower mold from a cope flask and a lower filling frame (see Patent Literature 1).

This conventional molding machine and molding process are implemented by, for instance, a hydraulically activated and pneumatically activated molding machine. However, such a molding machine involves the following problems. The hydraulic activation requires a hydraulic unit and thus increases the initial costs for a hydraulic pump and a hydraulic valve, while the pneumatic activation requires a larger cylinder to maintain sufficient power required by the setting flask and squeezing processes.

Under these circumstances, the applicant of the present application has conceived a combined driving mechanism that is a combination of pneumatic equipment and hydraulic equipment in the molding machine to use an air-on-oil system when cylinders are activated for a squeezing process and for switching pressures to drive the cylinder between a process for setting a flask and the squeezing process (see Patent Literature 2). As used herein, the term "air-on-oil system" refers to a plan for an operation to transform a pneumatic low-pressure to a hydraulic pressure to be used in the molding machine based on the hybrid functionality of the pneumatic pressure and the hydraulic pressure.

The driving mechanism described in Patent Literature 2, however, deals with no possibility of making the upper mold and the lower mold at the same time. Thus, it is unknown how to change the pressures of the air-on-oil system to be applied to the respective cylinders to appropriately operate the molding machine. Of course, Patent Literature 2 makes no mention of steps for removing the molds or for stacking the molds.

However, controlling adequate velocities and pressures are important matters for the step for removing molds or the step for stacking molds. For instance, in the step of removing molds, both removing the upper mold from an upper pattern and removing the lower mold from a lower pattern should be carried out slowly and gently. An inadequate control of the velocity results in molds with degraded qualities. A two-velocity control by the pneumatic pressure activation involves difficulties in adjusting the velocities, while a one-velocity control, which operates slowly, needs a significant operating time. In contrast, if the molds are removed at high velocities, it results in defective molded products, and a partial failure to remove the molds, called a "collapse of a sand mold." Accordingly, molded products having high qualities cannot be obtained.

Similarly, in the step for stacking the molds, applying a high pressure or a high velocity to bring the produced upper mold and the produced lower mold close to each other often involves an impact on them that collapses or breaks them. Therefore, there is a possibility of producing defective molded products.

PRIOR-ART LITERATURE

Patent Literature

[Patent Literature 1] Japanese Patent Laid-open Publication No. S59-24552

[Patent Literature 2] Japanese Patent Publication No. S43-2181

SUMMARY

Technical Problem

The object of the present invention is to provide a molding machine and a molding process for simultaneously making an upper mold and a lower mold, while an air-on-oil system exerts its function optimally by using pneumatic pressure and a booster cylinder. The booster cylinder increases the pneumatic pressure and transforms the increased pneumatic pressure to hydraulic high-pressure so as to operate the respective molding steps for simultaneously making an upper mold and a lower mold. The present invention focuses attention on the fact that a cylinder for setting flasks and for squeezing molding sand ("flask-setting and squeezing cylinder") performs key functions in steps for setting the flasks, squeezing the molding sand, removing the molds, and stacking the molds. The present invention thus provides the molding machine and the molding process as described above, without a hydraulic unit, using the pneumatic pressure and the booster cylinder to increase the pneumatic pressure and to transform the increased pneumatic pressures to hydraulic high-pressure such that the respective steps operate at optimum timings, to thereby simultaneously make the upper mold and the lower mold.

Solution

The molding machine of the present invention comprises a drag flask that is arranged such that it can be carried in and carried out of a site adapted to make molds; a matchplate mounted on an upper surface of the drag flask and having patterns on both surfaces thereof; a lower filling frame that can be raised and lowered and having sidewalls with sand-filling ports, the lower filling frame being coupled to the lower end of the drag flask such to raise and lower the lower filling frame; a lower squeezing board to be raised and lowered for defining a lower molding space together with the drag flask and the matchplate; an upper squeezing board that is fixed above and opposed to the matchplate; a cope flask for defining an upper molding space together with the matchplate and the upper squeezing board; a flask-setting and squeezing cylinder for allowing the lower squeezing board to be raised and lowered to set the cope and drag flasks and to squeeze the molding sand; a driving mechanism that includes a pneumatic piping system and a hydraulic piping system for driving the flask-setting and squeezing cylinder using an air-on-oil system; a controller for controlling the driving mechanism; upon the drag flask, the matchplate, the lower filling frame, and the lower squeezing board defining the lower molding space, while the matchplate, the upper squeezing board, and the cope flask define the upper molding space, the controller controls the driving mechanism to drive the flask-setting and squeezing cylinder at a low pressure; and upon the lower squeezing board being raised to squeeze the molding sand for simultaneously making an upper mold and a lower mold, the controller controls the driving mechanism to drive the flask-setting and squeezing cylinder at a high pressure that is increased by a booster cylinder.

The molding process for simultaneously making an upper mold and a lower mold of the present invention comprises the steps of defining upper and lower molding spaces, wherein the lower molding space is defined by a drag flask that is arranged to be carried into and out from a site adapted to make molds, a matchplate mounted on an upper surface of the drag flask and having patterns on both surfaces thereof, a lower filling frame to be raised and lowered, having sidewalls with sand-filling ports, being coupled to a lower end of the drag flask to raise and lower the lower filling frame, and a lower squeezing board to be raised and lowered, while the upper molding space is defined by an upper squeezing board that is fixed above and opposite to the matchplate and a cope flask; introducing molding sand to the upper molding space and the lower molding space at the same time; simultaneously making the upper mold and the lower mold by allowing the lower squeezing board lowers to squeeze the molding sand; removing the upper mold from the pattern on the upper surface of the matchplate, while removing the lower mold from the pattern on the under surface of the matchplate; and stripping the upper mold from the cope flask, while stripping the lower mold from the drag flask, characterized in that in the step of defining the upper and lower molding spaces the lower molding space is defined by using a driving mechanism based on an air-on-oil system to drive a flask-setting and squeezing cylinder for setting the cope and drag flasks and for squeezing the molding sand, while the upper molding space is defined by operating the flask-setting and squeezing cylinder at a low pressure; and in the step of simultaneously making the upper mold and the lower mold squeezing the molding sand by operating the flask-setting and squeezing cylinder at a high pressure that is increased by a booster cylinder.

Advantages of the Invention

With the molding machine and the molding process of the present invention, the driving mechanism is provided such that by an air-on-oil system it drives a cylinder for setting the flasks and for squeezing the molding sand to raise and lower the lower squeezing board and its associated components when upper and lower molding spaces are defined and molding sand therein is squeezed. The driving mechanism can be adequately controlled. With the present invention, supplying just the pneumatic pressure can generate a high power so as to simultaneously make an upper mold and a lower mold, while the step for squeezing can be carried out at the optimum timing. Further, controlling the air-on-oil system enables the lower squeezing board and the associated components to adequately move in conformity with each step. Accordingly, the present invention provides a simplified and compact configuration and an ease of maintenance, while high-quality molds can be made without any collapse of a mold such as caused by a failure to remove the molds. The present invention, in particular, utilizes the pneumatic pressures and the booster cylinder to increase the pneumatic pressures and to transform the increased pneumatic pressures to the hydraulic high-pressures, and no dedicated hydraulic unit is required. Also, a booster that boosts pressure only when high pressure is required can be compact. Therefore, the molding machine can be made compact beyond conventional possibilities. Further, because the present invention omits the hydraulic unit, the configuration of a controlling means such as a sequencer can itself be significantly simplified. In particular, for instance, a circuit breaker and a magnet switch, which constitute circuits for driving, e.g., a hydraulic pump, can be omitted. Thus the molding machine can be made compact at low cost.

The accompanying drawings, which are incorporated in and constitute a part of the specification, schematically illustrate the preferred embodiment of the present invention, and, together with the general description given above and the detailed description of the preferred embodiment given below, serve to explain the principles of the present invention.

BRIEF DESCRIPTIONS OF THE DRAWINGS

FIG. 8(B) is a flowchart of the operations of a plurality of cylinders in the respective steps in FIG. 8 (A).

DETAILED DESCRIPTIONS OF THE EMBODIMENTS

Figure 1:
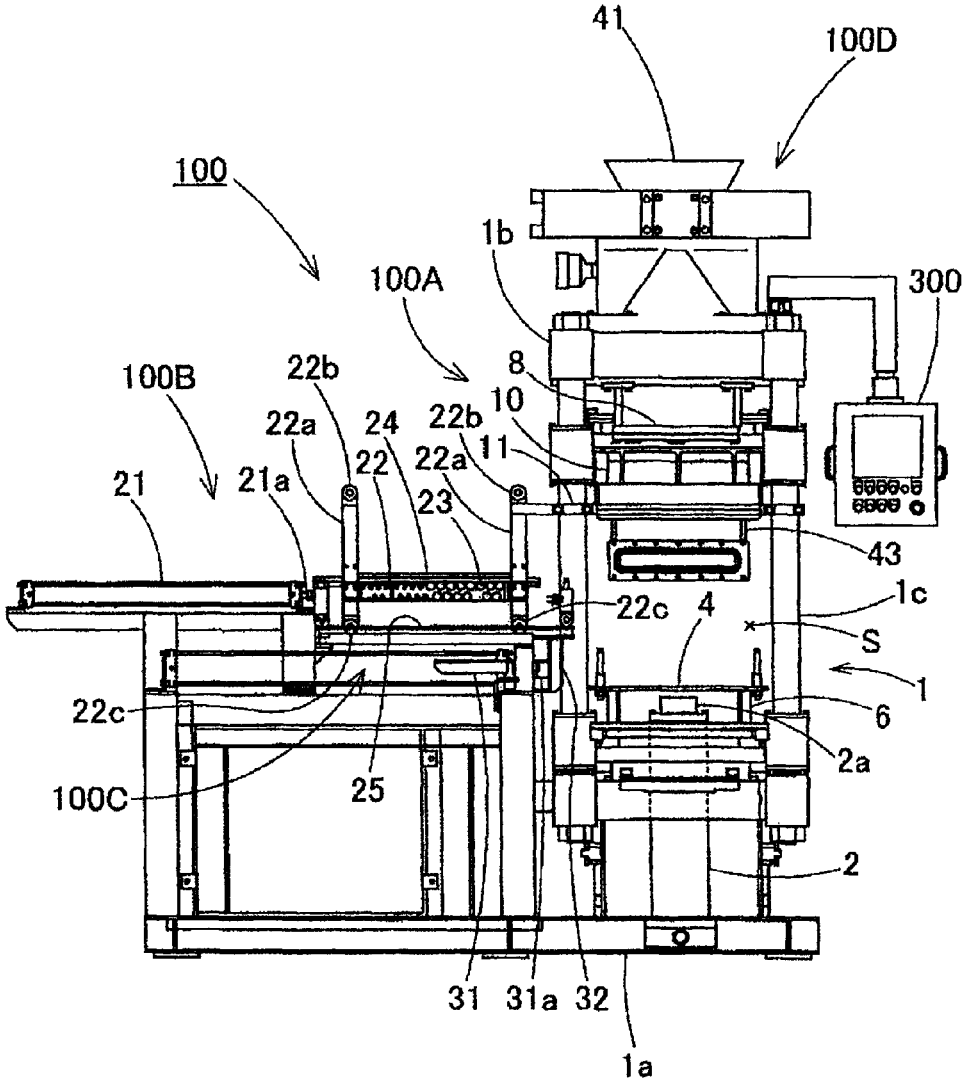
FIG. 1 is a front view illustrating one example of the molding machine of the first embodiment of the present invention.

The molding machines and molding processes of the present invention will now be explained by reference to the drawings. First, the molding machine 100 of the first embodiment of the present invention will be explained by reference to FIGS. 1-16.

1. The First Embodiment

The molding machine 100 of this embodiment includes a drag flask, which is arranged such that the drag flask can be carried in and carried out of a site adapted to make molds, a matchplate mounted on the upper surface of the drag flask and having patterns on both surfaces thereof, a lower filling frame, whose sidewalls have sand-filling ports, enabling the lower end of the drag flask to be coupled such that the lower filling frame can be raised and lowered, a lower squeezing board that enables a lower molding space, together with the drag flask, to be defined, the matchplate to be raised and lowered, an upper squeezing board that is fixed above and opposed to the lower squeezing board, a cope flask that can define an upper molding space together with the matchplate and the upper squeezing board, a cylinder for moving the lower squeezing board up and down to set the cope and drag flasks and squeeze the molding sand ("flask-setting and squeezing cylinder"), pneumatic and hydraulic piping systems, a driving mechanism for driving the cylinder to set the cope and drag flasks and squeeze the molding sand using an air-on-oil system and a controller for controlling the driving mechanism.

In the molding machine 100 of this embodiment, the controller controls the drag flask, the matchplate, the lower filling frame, and the lower squeezing board to define the lower molding space while that controller controls the matchplate and the upper squeezing board, and the cope flask defines the upper molding space. With these controls, although the flask-setting and squeezing cylinder operates at a low pressure, this cylinder operates at a high pressure. It is increased by a booster cylinder when the flask-setting and squeezing cylinder lifts up the lower squeezing board, to squeeze the molding sand and to simultaneously make the upper mold and the lower mold.

The molding process of the present invention, using the molding machine 100, relates to "a process for simultaneously making two molds" for making the upper mold and the lower mold at the same time. In particular, the molding process of the present invention relates to a process that comprises the steps for defining upper and lower molding spaces in which the lower molding space is defined by a drag flask, which is arranged such that the drag flask can be carried in and carried out from a site adapted to make molds, a matchplate mounted on an upper surface of the drag flask and having patterns on both surfaces thereof, a lower filling frame, whose sidewalls, having sand-filling ports, enable it to be coupled to a lower end of the drag flask, and a lower squeezing board that can be raised and lowered, while the upper molding space is defined by an upper squeezing board that is fixed above and opposed to the lower squeezing board and a cope flask; introducing molding sand to the upper molding space and the lower molding space at the same time; moving up the lower squeezing board to squeeze the molding sand to make the upper mold and the lower mold at the same time; and removing the upper mold from the pattern on the upper surface of the matchplate, while removing the lower mold from the pattern on the under surface of the matchplate; and stripping the upper mold from the cope flask, while stripping the lower mold from the drag flask.

In one embodiment of the molding process of the present invention, in the step for defining the upper and lower molding spaces, the lower molding space is defined by operating a cylinder for setting the cope and drag flasks and squeezing the molding sand ("a flask-setting and squeezing cylinder") with a driving mechanism for driving the flask-setting and squeezing cylinder using an air-on-oil system.

Further, in this embodiment of the molding process, the lower molding is defined as described above, while the upper molding space is defined by operating the flask-setting and squeezing cylinder at a low pressure. In the step for squeezing the molding sand, the flask-setting and squeezing cylinder squeezes the molding sand at the high pressure, which is increased by a booster cylinder.

As used herein, the term "a site adapted to make molds" refers to a site surrounded by the columns of the molding machine.

The term "a matchplate" refers to a plate in which patterns are provided on both surfaces of a pattern plate.

The term "a step for defining upper and lower molding spaces" includes defining the upper molding space after the lower molding space has been defined, or defining the upper and lower molding spaces at the same time.

The term "a lower filling frame whose sidewalls have sand-filling ports" refers to a lower filling frame in which its sides (sidewalls) are provided with sand-filling ports for introducing the molding sand.

Although the term "molding sand" does not define what type it is, green sand, for using a bentonite as a bonding agent, may be preferred.

The term "introducing molding sand" includes, but is not limited to, for instance, introducing the molding sand using, e.g., air, through the cope flask and the lower filling frame, in both of which sidewalls have sand-filling ports. Note that the present invention is not intended to introduce molding sand.

The term "a lower squeezing board" refers to a board for hermetically squeezing the molding sand that has been filled in the lower molding space in the drag flask.

The term "a flask-setting and squeezing cylinder using an air-on-oil system" refers to a cylinder that can be activated by the air-on-oil system.

In one embodiment of the present invention, preferably the lower filling frame is configured such that it can be "raised independently from and simultaneously with" the lower squeezing board. In this configuration, independently of the lower squeezing board, only the lower filling frame is raised by means of a cylinder of the lower filling frame, while the lower squeezing board is raised by means of the flask-setting and squeezing cylinder. The lower filling frame can be raised simultaneously with the lower squeezing board.

As used herein, the term "a booster cylinder" refers to a hybrid functional cylinder that has a pneumatic function and a hydraulic function and that utilizes Pascal's principle such that it transforms pneumatic low-pressure to hydraulic high-pressure. The air-on-oil system needs no hydraulic pump, but uses just a pneumatic-pressure source.

The term "pattern shuttle cylinder" refers to a cylinder for moving the matchplate in which patterns are provided on both surfaces, between the site adapted to make molds are produced and a standby position.

The molding machine and the molding process of this embodiment will now be explained in further detail by reference to the drawings.

The molding machine 100 of this embodiment, as illustrated in FIGS. 1-5, generally comprises a molding section 100A for making a mold that comprises the upper mold and the lower mold, a forward and backward driving section 100B for moving the drag flask forward to and backwardly from the molding section 100A, a pushing-out section 100C for pushing out the molds that have been made in the molding section 100A to the outside therefrom, and a molding sand-supplying section 100D for supplying the molding sand to the molding section 100A.

(1) Molding Section 100A

The molding machine 100 includes a gantry frame 1. The gantry frame 1 is configured such that a lower base frame 1*a* and an upper base frame 1*b* are integrally coupled by columns 1C in each of the four corners in the plan of the gantry frame 1.

Figure 4:
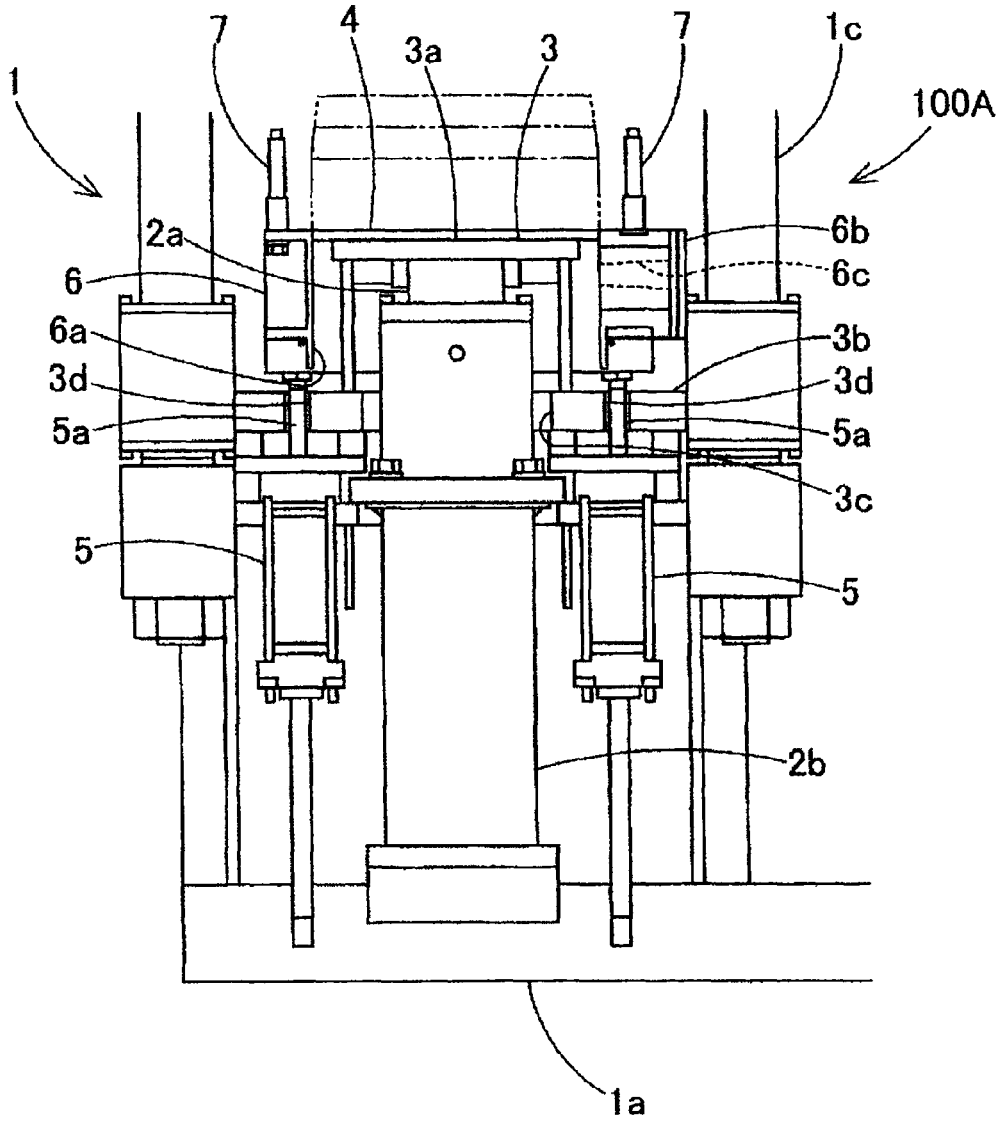
FIG. 4 is a schematically enlarged view of the area around the lower squeezing board of the molding machine of FIG. 1.

As illustrated in FIG. 4, a flask-setting and squeezing cylinder 2 is upwardly mounted on the central part of the upper surface of the lower base frame 1*a*. The distal end of a piston rod 2*a* of the flask-setting and squeezing cylinder 2 is attached to a lower squeezing board 4 through an upper end 3*a* of the lower squeezing frame 3. The main body 2*b* of the flask-setting and squeezing cylinder 2 is inserted through an insertion opening 3*c* that is provided in the center of the lower end 3*b* of the lower squeezing frame 3.

Preferably, each of the four corners of the plan of the lower base frame 1*a* is provided with a slideable bushing (not shown), which is at least 10 mm high, such that the lower squeezing frame 3 maintains its horizontal position.

Four cylinders 5 of a lower filling frame are vertically mounted on the lower end 3*b* of the lower squeezing frame 3 such that they surround the flask-setting and squeezing cylinder 2. Each of the respective upper piston rods 5*a* of the respective cylinders 5 passes through a corresponding insertion opening 3*d* that is provided in the lower end 3*b* of the lower squeezing frame 3. Further, the respective distal ends of the piston rods 5*a* are attached to a lower filling frame 6.

The lower filling frame 6 is configured such that its inner face 6*a* is formed as a diminishing taper such that the internal space of the lower filling frame 6 becomes narrower from top to bottom and thus the lower squeezing board 4 can be tightly closed and hermetically inserted therein. Sidewalls 6*b* of the lower filling frame 6 are provided with molding-sand introducing ports 6*c*. Positioning pins 7 stand on the upper surface of the lower filling frame 6.

As described above, on the distal end of the piston rod 2*a* of the flask-setting and squeezing cylinder 2, the lower squeezing board 4 is mounted through the upper end 3*a* of the lower squeezing frame 3, while on the distal ends of the upper piston rods 5*a* of the respective cylinders 5 the lower filling frame 6 is mounted. Therefore, in such an arrangement, when the piston rod 2*a* of the flask-setting and squeezing cylinder 2 is retracted, at the same time the lower squeezing board 4, the lower squeezing frame 3, the cylinders 5, and the lower filling frame 6 are raised or lowered, in unison. Further, when the upper piston rods 5*a* of the respective cylinders 5 are retracted, the lower filling frame 6 ascends or descends.

Figure 5:
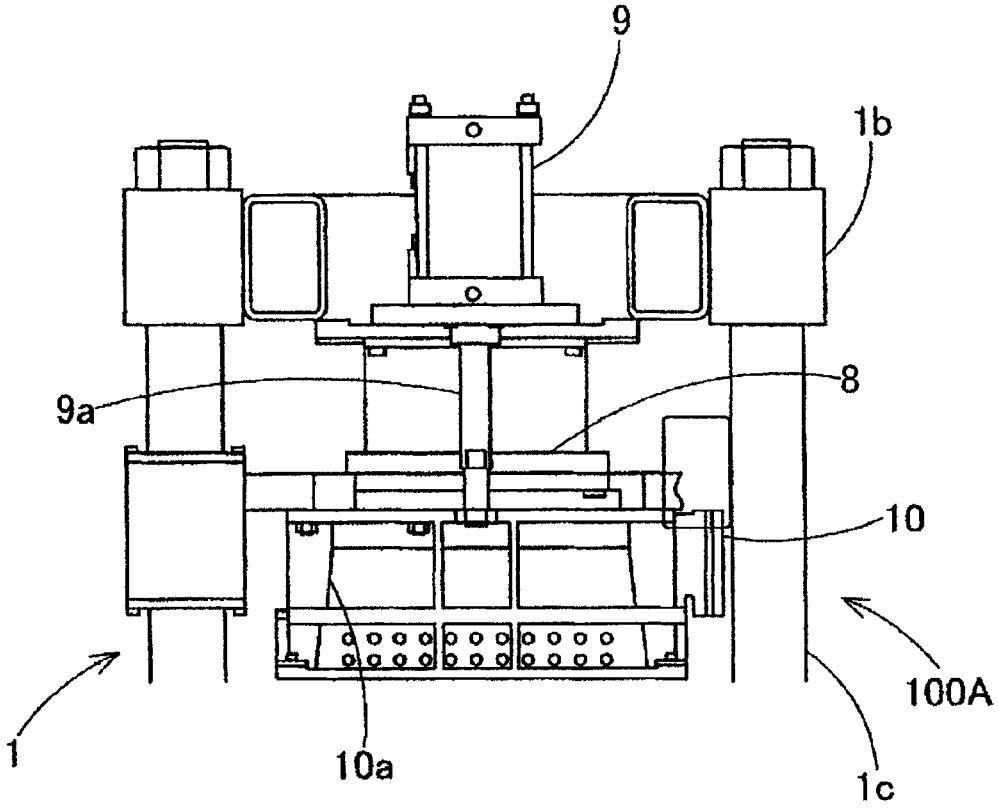
FIG. 5 is a schematically enlarged view of the area around the cylinder of the cope flask of the molding machine of FIG. 1.

As illustrated in FIG. 5, on the under surface of the upper base frame 1*b*, an upper squeezing board 8 is fixedly provided and is in an upper opposed position to the lower squeezing board. On the upper base frame 1*b*, a cylinder 9, which is an air cylinder for a cope flask, is downwardly and fixedly mounted. The cope flask 10 is fixed to the distal end of a piston rod 9*a* of the cylinder 9.

The cope flask 10 is configured such that its inner face 10*a* is formed as a taper such that the internal space of the cope flask 10 becomes wider from top to bottom and thus the upper squeezing board 8 can be tightly closed and closely inserted therein. As especially seen in FIG. 7, sidewalls 10*b* of the cope flask 10 are provided with molding-sand introducing ports 10*c*.

A space S is formed in a position midway between the upper squeezing board 8 and the lower squeezing board 4 such that a drag flask 23 (described below) can be inserted therein. In turn, the inserted drag flask 23 within the space S can be raised and lowered.

Inside the columns 1*c*, a pair of traveling rails 11 are arranged and elongated parallel to the right-left direction on the same horizontal plan (hereinafter, the "right-left direction" is defined with reference to the state illustrated in FIG. 1).

(2) Forward and Backward Driving Section 100*b* for Moving the Drag Flask

The forward and backward driving section 100B is placed in the left side or the right side of the columns 1*c* (in the embodiment of FIG. 1, the driving section 100B is placed in the left side of the columns 1*c*).

The forward and backward driving section 100B is equipped with a pattern shuttle cylinder 21, which is arranged to face to the right. On the distal end of a piston rod 21*a* of the pattern shuttle cylinder 21, a master plate 22 is mounted in its horizontal position such that the master plate 22 can be separated upwardly from the distal end of the piston rod 21*a*.

On the under surface of the master plate 22, the drag flask 23 is mounted.

On the upper surface of the master plate 22, the matchplate 24, in which the patterns are provided on both surfaces, is mounted.

Each of the four corners of the master plate 22 in the plan is provided with a vertical roller arm 22. Flanged rollers 22*b* and 22*c* are disposed on the upper end and the lower end, respectively, of each vertical roller arm 22*a*.

When the piston rod 21*a* of the pattern shuttle cylinder 21 is retracted, the four lower flanged rollers 22*c* are contacted by a pair of guiding rails 25 that are arranged and elongated parallel to the right-left direction on the same horizontal plane such that the flanged rollers 22*c* can be rolled along the guiding rails 25. When the piston rod 21 is extended, each flanged roller 22*c* is then separated from the pair of guiding rails 25 and moved inside the corresponding column 1*c*

The four upper flanged rollers 22*b* are configured such that when the piston rod 21*a* of the pattern shuttle cylinder 21 is retracted, just two right flanged rollers 22*b* are loaded on the left ends of the pair of the traveling rails 11 that are extended from the columns 1*c*, while the remaining two left flanged rollers 22*b* are also mounted on the pair of the traveling rails 11 when the piston rod 21*a* is extended.

(3) Pushing-Out Section 100*c* for Pushing Out the Molds

The pushing-out section 100C is placed in the left side or the right side of the columns 1*c*. (In the embodiment of FIG. 1, the pushing-out section 100C is placed in the left side of the columns 1*c*.)

The pushing-out section 100C is equipped with a pushing cylinder 31 for pushing out the molds such that the cylinder 31 is arranged to face to the right. On the distal end of the piston rod 31*a* of the pushing cylinder 31, a pushing-out plate 32 is coupled.

(4) Molding Sand-Supplying Section 100*d*

The molding sand-supplying section 100D is mounted on the upper base frame 1*b*.

The molding sand-supplying section 100D includes a molding sand-supplying port 41, a sand gate 42 for opening and closing the molding sand-supplying port 41, and an aeration tank 43, which tank is located beneath the sand gate 42. As especially seen in FIG. 9, a leading end of the sand tank 43 diverges in two directions, i.e., above and below, to form sand-introducing ports 43*a*.

An electric system and a pneumatic and hydraulic system in the molding machine 100 described above will now be explained.

Figure 6:
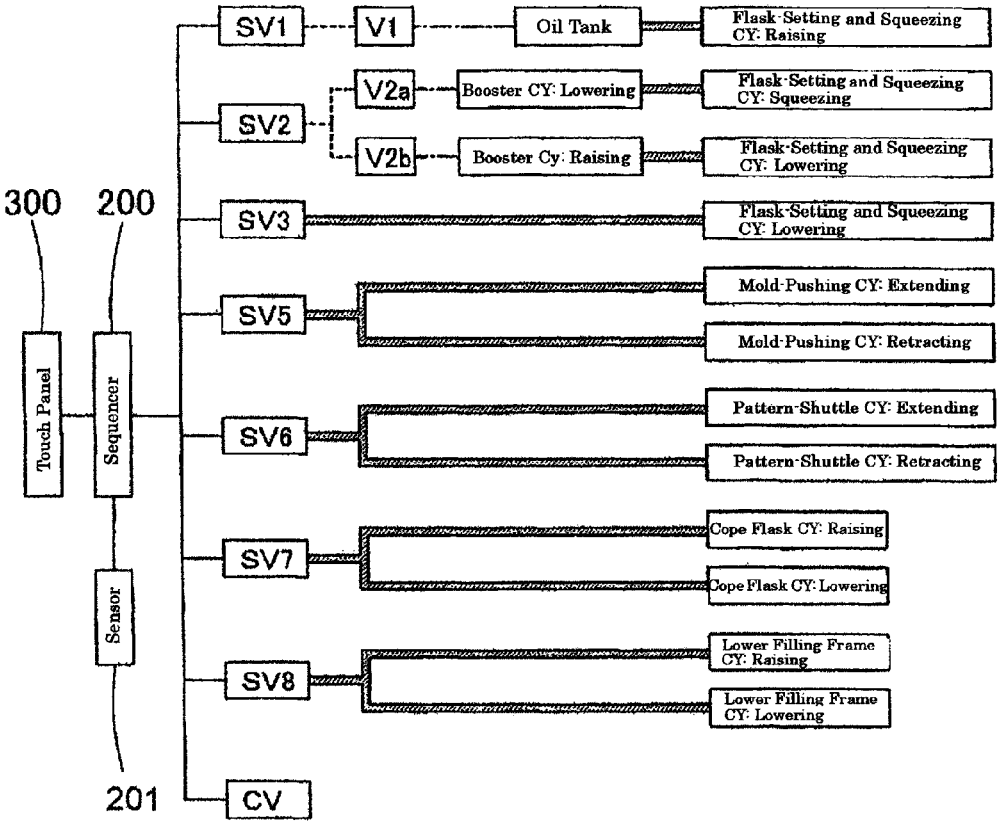
FIG. 6 is a block diagram illustrating the electric system and the pneumatic-hydraulic system of the molding machine of FIG. 1.

As illustrated in FIG. 6, the electric system of the molding machine 100 includes a sequencer 200 (as "a controlling means") and is configured such that a touch panel (see FIGS. 1, 2, and 3), solenoid valves SV1, SV2, SV3, SV5, SV6, SV7, SV8, and a cutting valve CV, are electrically connected to the sequencer 200. The sequencer 200 is also electrically connected to various sensors 201. The sensors 201 include, for instance, a sensor for sensing a returned end, i.e., the end of the retracted position for the pushing cylinder for pushing out the molds, a pressure switch PS (described below), a pressure switch for monitoring to ascertain that the pressure of supplied compressed air is higher than a predetermined pressure, lead switches or proximity switches for identifying the end and the beginning of the movement of the respective cylinders, and a proximity switch for observing that a mold under a squeezing process is not less thick than a predetermined thickness.

As described below, the solenoid valves SV1, SV2, and SV3, and the cutting valve CV, constitute a driving mechanism 400 for operating the flask-setting and squeezing cylinder 7.

The solenoid valve SV5 supplies air to and drains air from the pushing cylinder 22 for pushing out the mold to extend and retract the piston rod 31*a*.

The solenoid valve SV6 supplies air to and drains air from the pattern shuttle cylinder 21 to extend and retract the piston rod 21*a*.

The solenoid valve SV7 supplies air to and drains air from the cylinder 9 of the cope flask to extend ("lower") and retract ("raise") the piston rod 9*a*.

The solenoid valve SV8 supplies air to and drains air from the cylinder 9 of the lower filling frame to extend ("raise") and retract ("lower") the piston rod 5*a*.

The driving mechanism 400 for operating the flask-setting and squeezing cylinder 7 will now be explained.

Figure 7:
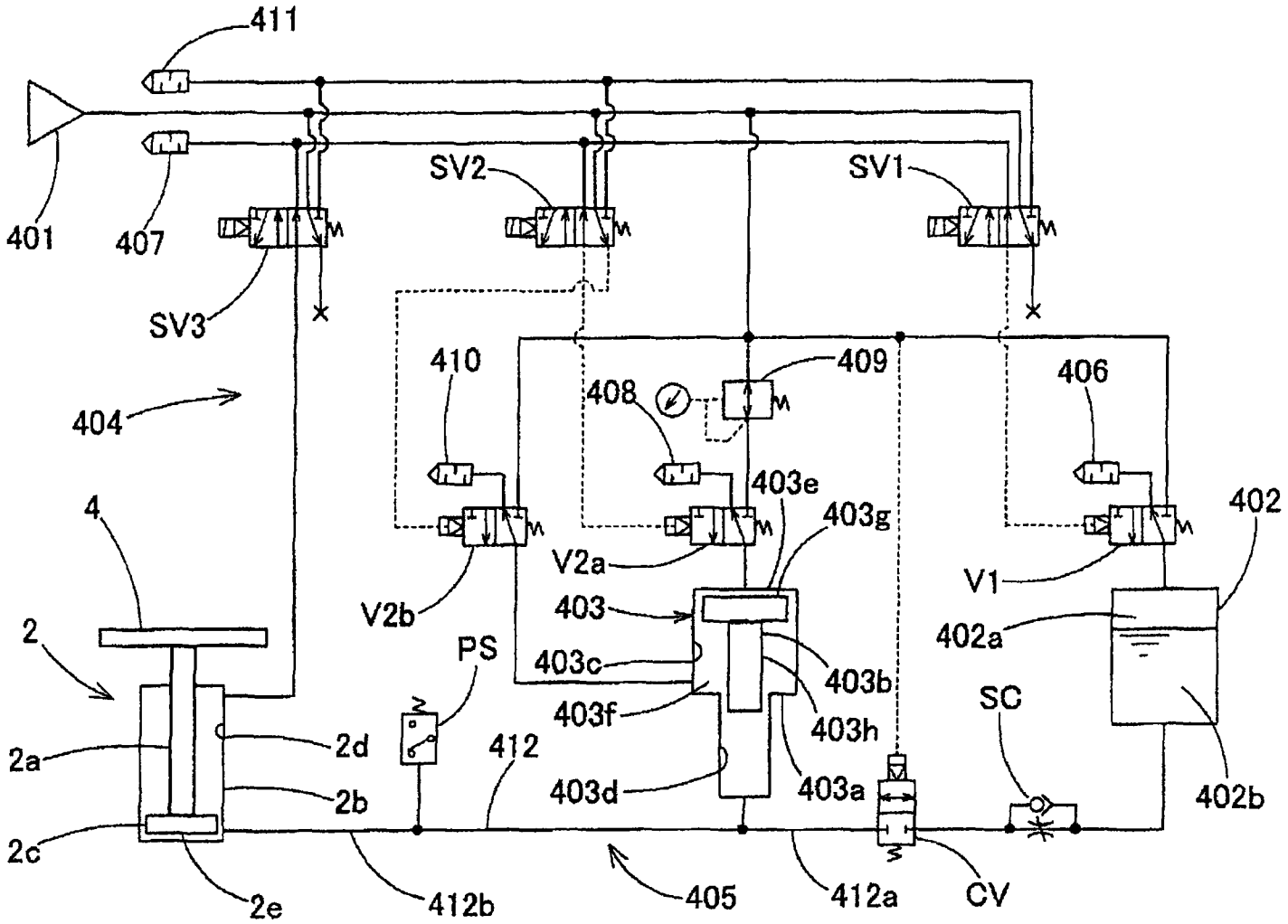
FIG. 7 is a pneumatic-hydraulic circuit diagram of the driving mechanism to drive the cylinder for setting flasks and for squeezing the molding sand of the molding machine of FIG. 1.

As illustrated in FIG. 7, the driving mechanism 400 includes a compressed-air source 401, a hydraulic oil tank 402, and a booster cylinder 403, such that the driving mechanism 400 is configured from a hybrid circuit that comprises a pneumatic circuit 404 and a hydraulic circuit 405 so as to form an air-on-oil system. The air-on-oil system refers to a driving scheme to transform a pneumatic pressure to a hydraulic pressure to be used. The air-on-oil system uses only the compressed-air source, without using any dedicated hydraulic unit having a hydraulic pump.

(1) Pneumatic Circuit 404

The pneumatic circuit 404 will now be explained.

The upper part of the hydraulic oil tank 402 has a pneumatic chamber 402*a* such that it is in fluid communication with either the compressed-air source 401 or the atmosphere (a silencer 406) through a valve (a first valve) V1, which is controlled in two positions by being interlocked with the solenoid valve (a first solenoid valve) SV1. The solenoid valve SV1, when no current is applied, causes the controlling port of the valve V1 to fluidly communicate with a silencer 407, to maintain the valve V1 in an inactive condition such that the pneumatic chamber 402*a* of the hydraulic oil tank 402 fluidly communicates with the silencer 406, to maintain the atmospheric pressure within the pneumatic chamber 402*a*. Also, the solenoid valve SV1, when applying current, causes the controlling port of the valve V1 to fluidly communicate with the compressed-air source 401, to maintain the valve V1 in an active condition such that the pneumatic chamber 402*a* of the hydraulic oil tank 402 fluidly communicates with the compressed-air source 401, to supply compressed air to the pneumatic chamber 402*a*.

The booster cylinder 403 includes a cylinder part 403*a* and a piston part 403*b*. The cylinder part 403*a* is provided with a pneumatic chamber 403*c* in the upper part of it and a hydraulic chamber 403*d* in the lower part. The ratio of the cross-sectional area of the pneumatic chamber 403*c* to that of the hydraulic chamber 403*d* has a large value, e.g., 10:1. The piston part 403*b* is located in the pneumatic chamber 403*c* of the cylinder part 403*a* and includes a large-diameter piston section 403*g* and a small-diameter piston section 403*h*. The large-diameter piston section 403*g* divides the pneumatic chamber 403*c* into a top pneumatic chamber 403*e* and a bottom pneumatic chamber 403*f*. The small-diameter piston section 403*h* downwardly extends from the large-diameter piston section 403*g* so as to have the distal end of the small-diameter piston section 403*h* be located within the hydraulic chamber 403*d*. The booster cylinder 403 generates the hydraulic pressure to increase it ten times more than the compressed-air pressure, if the ratio of the area described above is 10:1.

The top pneumatic chamber 403*e* of the booster cylinder 403 fluidly communicates with either the compressed-air source 401 or the atmosphere (a silencer 408) through a valve (a second valve) V2*a*, which is controlled at two positions by interlocking with the solenoid valve (a second solenoid valve) SV2. The solenoid valve SV2, when no current is applied, causes the controlling port of the valve V2 to fluidly communicate with the silencer 407, to maintain the valve V2*a* in an inactive condition such that the top pneumatic chamber 403*e* of the booster cylinder 403 fluidly communicates with the silencer 408, to maintain an atmospheric pressure within the top pneumatic chamber 403*e*. Also, the solenoid valve SV2, when current is applied, causes the controlling port of the valve V2*a* to fluidly communicate with the compressed-air source 401, to maintain the valve V2 a in an active condition such that the top pneumatic chamber 403*e* fluidly communicates with the compressed-air source 401, to supply compressed air to the top pneumatic chamber 403*e*. A regulator 409 is provided in a pneumatic piping between the compressed-air source 401 and the valve V2.

The bottom pneumatic chamber 403*f* of the booster cylinder 403 is in fluid communication with either the compressed-air source 401 or atmosphere (a silencer 410) through a valve V2*b*, which is controlled at two positions by interlocking with the solenoid valve SV2. The solenoid valve SV2, when no current is applied, causes the controlling port of the valve V2*b* to fluidly communicate with the compressed-air source 401, to maintain the valve V2*a* in an active condition such that the bottom pneumatic chamber 403*f* of the booster cylinder 403 fluidly communicates with the compressed-air source 401, to supply the compressed air to the bottom of the pneumatic chamber 403*f*. Also, the solenoid valve SV2, when applying current, causes the controlling port of the valve V2*a* to fluidly communicate with a silencer 411, to maintain the valve V2*a* in an inactive condition such that the bottom pneumatic chamber 403*f* fluidly communicates with the silencer 410, to maintain a pneumatic pressure within the bottom pneumatic chamber 403*f*.

The flask-setting and squeezing cylinder 2 includes a main body (a cylinder part) 2*b*, a piston 2*c* that is located inside the main body 2*b*, and a piston rod 2*a* that is upwardly extended from the piston 2*c*. As described above, the distal end of the piston rod 2*a* is coupled to the lower squeezing board 4. The main body 2*b* includes a pneumatic chamber 2*d* in the upper part of the main body 2*b* and a hydraulic chamber 2*e*. The pneumatic chamber 2*d* and the hydraulic chamber 2*e* are divided by the piston 2*c*.

The pneumatic chamber 2*d* of the flask-setting and squeezing cylinder 2 is in fluid communication with either the compressed-air source 401 or the atmosphere (the silencer 407) through the solenoid valve (a third solenoid valve) SV3. The solenoid valve SV3, when current is not being applied, causes the pneumatic chamber 2*d* to fluidly communicate with the silencer 407, to maintain a pneumatic pressure within the pneumatic chamber 2*d*. Also, the solenoid valve SV3, when current is applied, causes the pneumatic chamber 2*d* to fluidly communicate with the compressed-air source 401, to supply the compressed air to the pneumatic chamber 2*d*.

(2) Hydraulic Circuit 405

Below are explanations of the hydraulic circuit 405. The hydraulic circuit 405 is configured such that the hydraulic oil tank 402 fluidly communicates with the hydraulic chamber 2*e* through a hydraulic piping 412. The hydraulic circuit 405 is configured such that a speed controller SC and a cutoff valve CV are arranged along a path of hydraulic oil in a hydraulic piping 2*a* in the side of the hydraulic oil tank 2, while the pressure switch PS is arranged in a hydraulic piping 412*b* in the side of the flask-setting cylinder 2. The pressure switch PS monitors hydraulic oil 402*b* in the hydraulic piping 412*b* to determine if it reaches a predetermined pressure.

The cutoff valve CV, when no current is applied, maintains a cutoff state between the hydraulic oil tank 402 and the hydraulic chamber 2*e* of the flask-setting and squeezing cylinder 2, and between the hydraulic oil tank 402 and the hydraulic chamber 403*d* of the booster cylinder 403. Meanwhile, the cutoff valve CV, when current is applied, is operated by compressed-air pressure to maintain fluid communication between the hydraulic oil tank 402 and the hydraulic chamber 2*e* of the flask-setting and squeezing cylinder 2, and between the hydraulic oil tank 402 and the hydraulic chamber 403*d* of the booster cylinder 403.

The cutoff valve CV may be a cutoff valve that is adapted to be a control for two velocities. Thus the flow of the hydraulic oil can be adjusted. In this case, the flask-setting and squeezing cylinder 2 can be adequately operated in response to the two velocities, i.e., a high speed and a low speed.

Now explained is a molding process in this embodiment, using the molding machine 100 described above. As illustrated in FIG. 8(A), the molding process comprises a series of steps, namely, bringing a pattern-shuttle in S1, setting the flasks S2, filling the molding sand S3, squeezing the molding sand S4, removing ("drawing") the molds S5, bringing the pattern-shuttle out S6, stacking the molds S7, stripping the flasks S8, and pushing out the molds S9.

First, the operations of the driving mechanism 400 for driving the flask-setting and squeeze cylinder in relation to the above respective steps are explained.

(1) Initial Conditions in the Start-Up of the Molding Process

In the initial conditions in a start-up of the molding process, both the solenoid valve SV1 and the solenoid valve SV2 are maintained in a non-energized state, while both the solenoid valve SV3 and the cutoff valve CV are maintained in an energized state.

Because the solenoid valve SV3 is in the energized state, the piston 2*c* and piston rod 2*a* of the flask-setting and squeezing cylinder 2 are in their lower end positions (i.e., the descent limit positions), while the lower squeezing board 4 is maintained in its lower end position (i.e., the descent limit position).

Because the cutoff valve CV is in the energized state, fluid communications are maintained between the hydraulic oil tank 402 and the hydraulic chamber 2*e* of the flask-setting and squeezing cylinder 2, and between the hydraulic oil tank 402 and the hydraulic chamber 403*d* of the booster cylinder 403.

(2) Step S1 of Bringing the Pattern-Shuttle in

In this step S1, like the initial conditions in the start-up of the molding process, both the solenoid valve SV1 and the solenoid valve SV2 are maintained in the non-energized state, while both the solenoid valve SV3 and the cutoff valve CV are maintained in the energized state.

(3) Step S2 of Setting the Flasks

In this step S2, energizing the solenoid valve SV1 is started, while the supply of electric energy to the solenoid valve SV3 is interrupted. Therefore, hydraulic oil 402*b* supplied to the hydraulic chamber 2*e* of the flask-setting and squeezing cylinder 2 lifts up the piston 2*c*. The lower squeezing board 4 then ascends through the piston rod 2*a* to set the flasks.

(4) Step S4 of Squeezing the Molding Sand

In this step S4, supplying the electric energy to the solenoid valve SV1 and to the cutoff valve CV is interrupted, while energizing the solenoid valve SV2 is started.

When the solenoid valve SV2 is electrically energized, the compressed air supplied to the upper pneumatic chamber 403*e* of the booster cylinder 403 depresses the large-diameter piston section 403*g*. In association with depressing the large-diameter piston section 403*g*, the small-diameter piston section 403*h* extrudes hydraulic oil 402*b* from the hydraulic chamber 403*d*. Because the extruded hydraulic oil 402*b* is then supplied to the hydraulic chamber 2*e* of the flask-setting and squeezing cylinder 2, the lower squeezing board 4 ascends to carry out the step of squeezing the molding sand.

Meanwhile, step S4 of squeezing the molding sand is completed when the pressure switch PS detects that the hydraulic oil 402*b* has reached a predetermined pressure.

(5) Step S5 of Removing (or Drawing) the Molds

In this step S5, supplying the electric energy to the solenoid valve SV2 is interrupted, while electrically energizing both the solenoid valve SV3 and the cutoff valve CV is started. Because thus the solenoid valve SV2 has no electricity, the piston section 403*b* ascends to its upper end position, i.e., the upper limit of its ascent.

In association with the cutoff valve CV being electrically energized, the fluid communications are returned between the hydraulic oil tank 402 and the hydraulic chamber 2*e* of the flask-setting and squeezing cylinder 2, and between the hydraulic oil tank 402 and the hydraulic chamber 403*d* of the booster cylinder 403.

When the solenoid valve SV2 is electrically interrupted, and while both the solenoid valve SV3 and the cutoff valve CV are electrically energized, the compressed-air pressure thus depresses the piston 2*c* of the flask-setting and squeezing cylinder 2, to thus extrude the hydraulic oil 402*b* from the hydraulic chamber 2*e*. The extruded hydraulic oil 402*b* is then returned in the hydraulic chamber 403*d* of the booster cylinder 403 and in the hydraulic oil tank 402. Therefore, the piston 2*c* of the flask-setting and squeezing cylinder 2 descends, while the piston part 403*b* of the booster cylinder 403 ascends.

(6) Step S7 of Stacking the Molds

In this step S7, like step S2 of setting the flasks, electrically energizing the solenoid valve SV1 is started, while supplying the electric energy to the solenoid valve SV3 is interrupted. Under these conditions, the incoming compressed air supplied in the pneumatic chamber 402*a* applies a depression force on the hydraulic oil 402*b* in the hydraulic oil tank 402 and thus extrudes it therefrom. The extruded hydraulic oil 402*b* is then supplied to the hydraulic chamber 2*e* of the flask-setting and squeezing cylinder 2 via the speed controller SC and the cutoff valve CV. The piston 2*c* of the flask-setting and squeezing cylinder 2 is thus caused to raise.

(7) Step S8 for Stripping the Flasks

In step S8, supplying the electric energies to the solenoid valve SV1 is interrupted, while electrically energizing the solenoid valve SV3 is started. In association with starting the energizing of the solenoid valve SV3, the pneumatic chamber 2*d* of the flask-setting and squeezing cylinder 2 is then caused to fluidly communicate with the compressed air-source 401 to supply compressed air to the pneumatic chamber 2*d*. Therefore, the supplied compressed air depresses the piston 2*c* of the flask-setting and squeezing cylinder 2 to extrude the hydraulic oil 402*b* from the hydraulic chamber 2*e*. The extruded hydraulic oil 402*b* is then returned in the hydraulic oil tank 402. The piston 2*c* of the flask-setting and squeezing cylinder 2 is then lowered.

Figure 8:
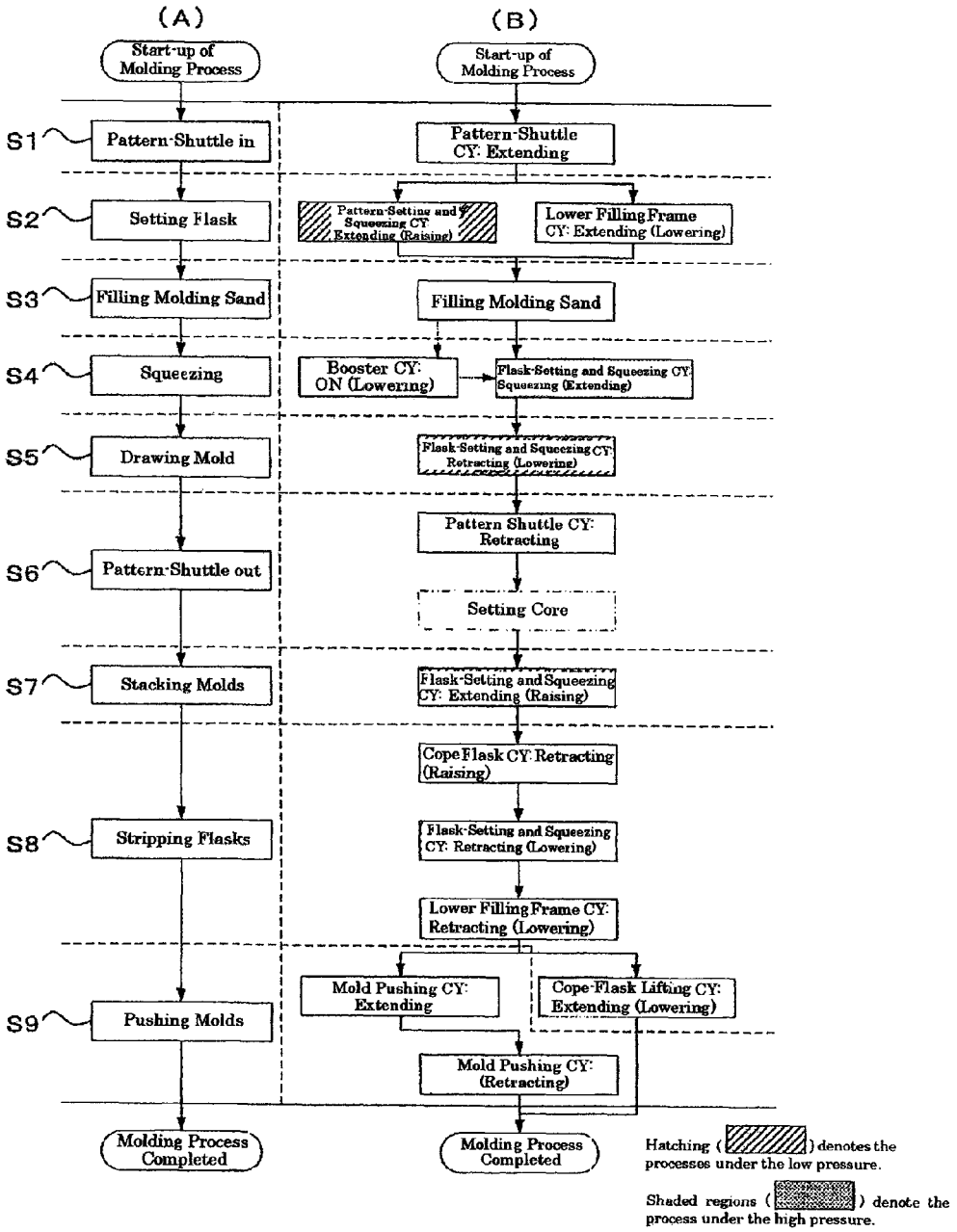
FIG. 8 (A) is a flowchart of the process for molding of the present invention using the molding machine of FIG. 1.

The series of the steps of the molding process of the above embodiment of the present invention will now be explained in the order of the respective steps. FIG. 8 (B) expresses the operation of the cylinder in each process.

(1) Initial Conditions in the Start-Up of the Molding Process (FIGS. 1, 2, 3, 4, and 5)

Under the initial conditions in the start-up of the molding process, in the molding section 100A, the piston rod 2*a* of the flask-setting and squeezing cylinder 2*a* is located in its retracted end position, while the lower squeezing board 4 is located in its lowered end position. The upper piston 5*a* of the cylinder 5 of the lower filling frame is located in its retracted end position, while the lower filling frame 6 is located in its lowered end position. The piston rod 9*a* of the cylinder of the cope flask is located in its extended end position, while the cope flask 10 is located in its lowered end position.

In the section 100 B for advancing and retracting the drag flask, the piston rod 21*a* of the pattern shuttle cylinder 21 is located in its retracted end position, while the master plate 22, the drag flask 23, and matchplate 24 are located in their corresponding retracted end positions.

In the section 100*c* for pushing out the molds, the piston rod 31*a* of the pushing-out cylinder 31 for pushing out the molds is located in its retracted end position, while the pushing-out plate 32 is located in its retracted end position.

In the mold-sand supplying section 100D, molding sand 51 (FIG. 9) is filled in the aeration tank 43.

Figure 2:
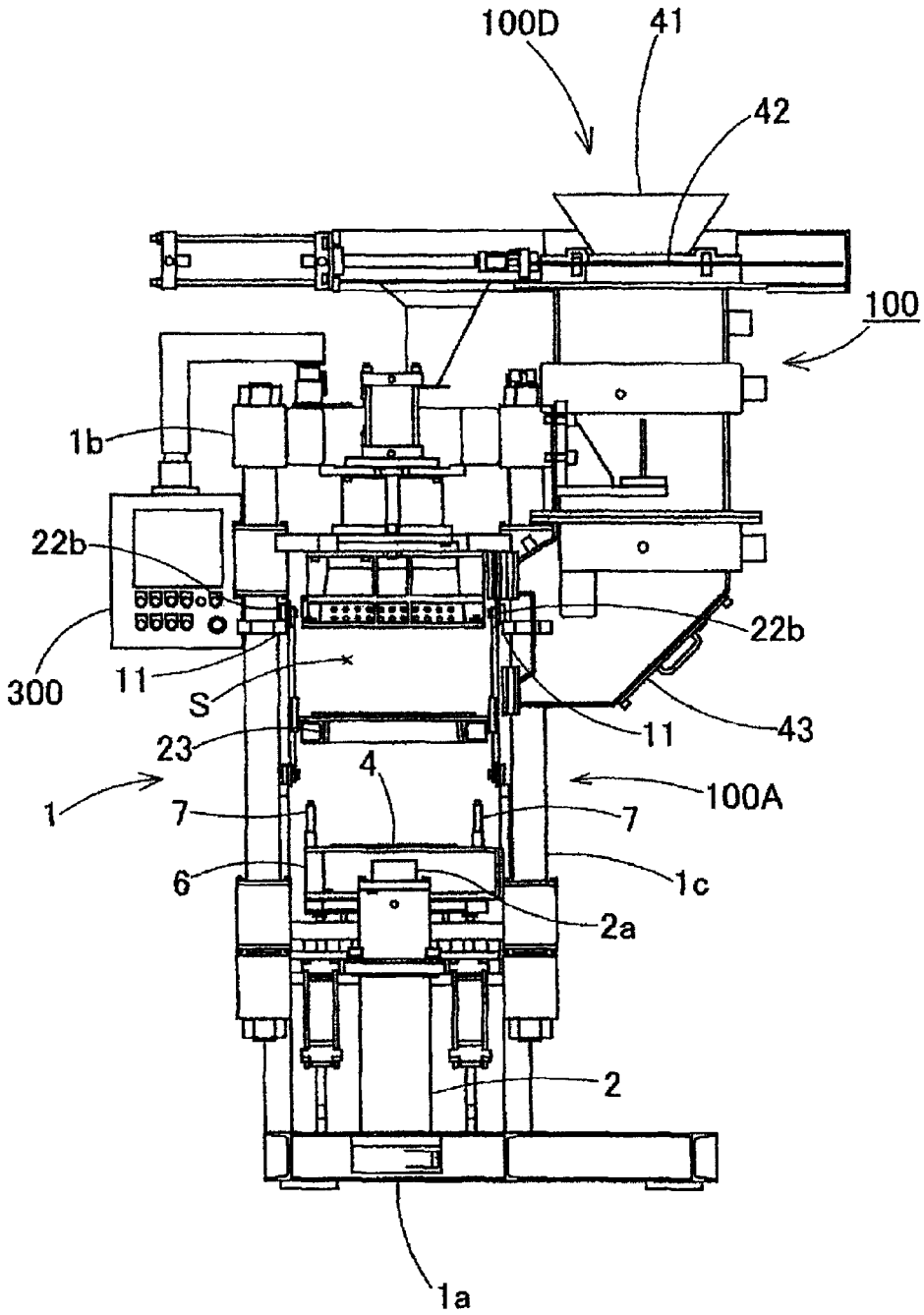
FIG. 2 is a side view of the molding machine of FIG. 1.
Figure 3:
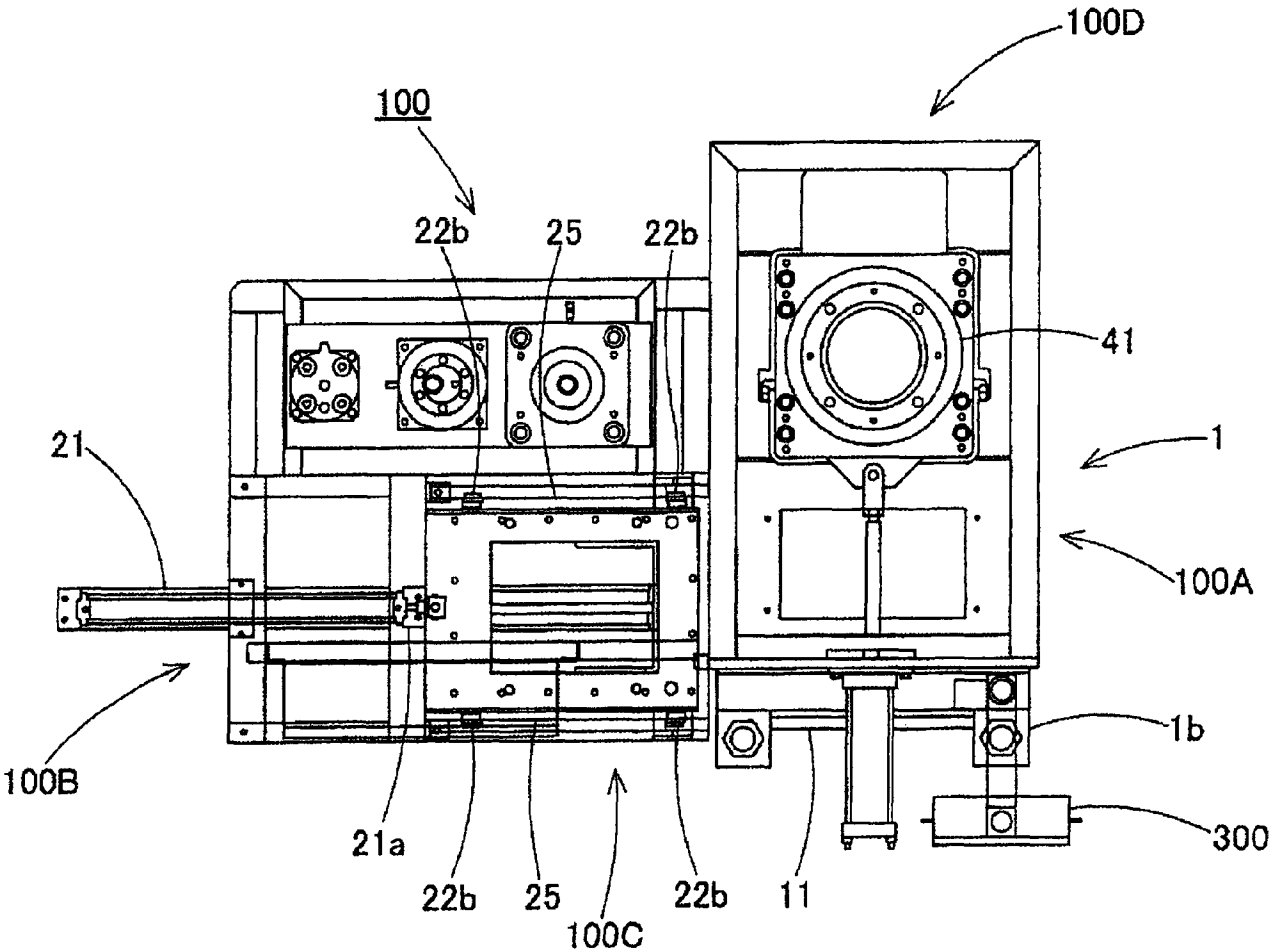
FIG. 3 is a plan view of the molding machine of FIG. 1.
Figure 9:
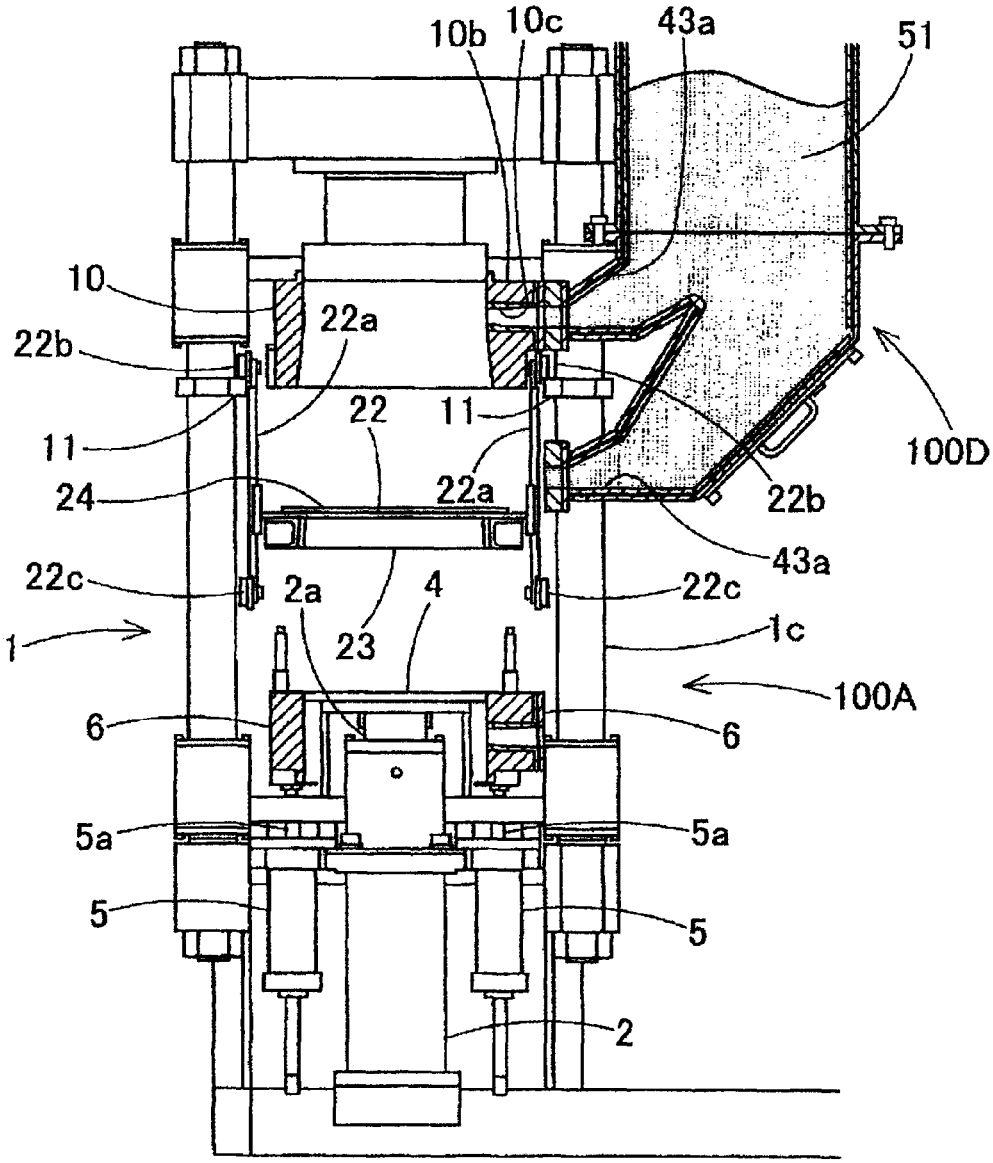
FIG. 9 is an illustration to explain the operations of the molding machine of FIG. 1 when the molding machine in FIG. 9 is in a state in which the step for shuttling in the pattern of the molding process of the present invention of FIG. 8(A) has just been completed.

(2) Step S1 of the Pattern Shuttle in (FIGS. 2 and 9)

In this step S1, the piston rod 21*a* of the pattern-shuttle cylinder 21 is forwardly extended, and in turn, the master plate 22 advances. Two flanged rollers 22*b* on the left side of the upper four flanged rollers 22*b* are mounted on the pair of the traveling rails 11, while the lower four flanged rollers 22*c* are separate from the pair of the guiding rails 25. When the piston rod 21*a* is forwardly extended to the extended end position, the master plate 22, the drag flask 23, and the matchplate 24, are all set in the predetermined locations inside the column 1C of the molding section 100A.

Figure 10:
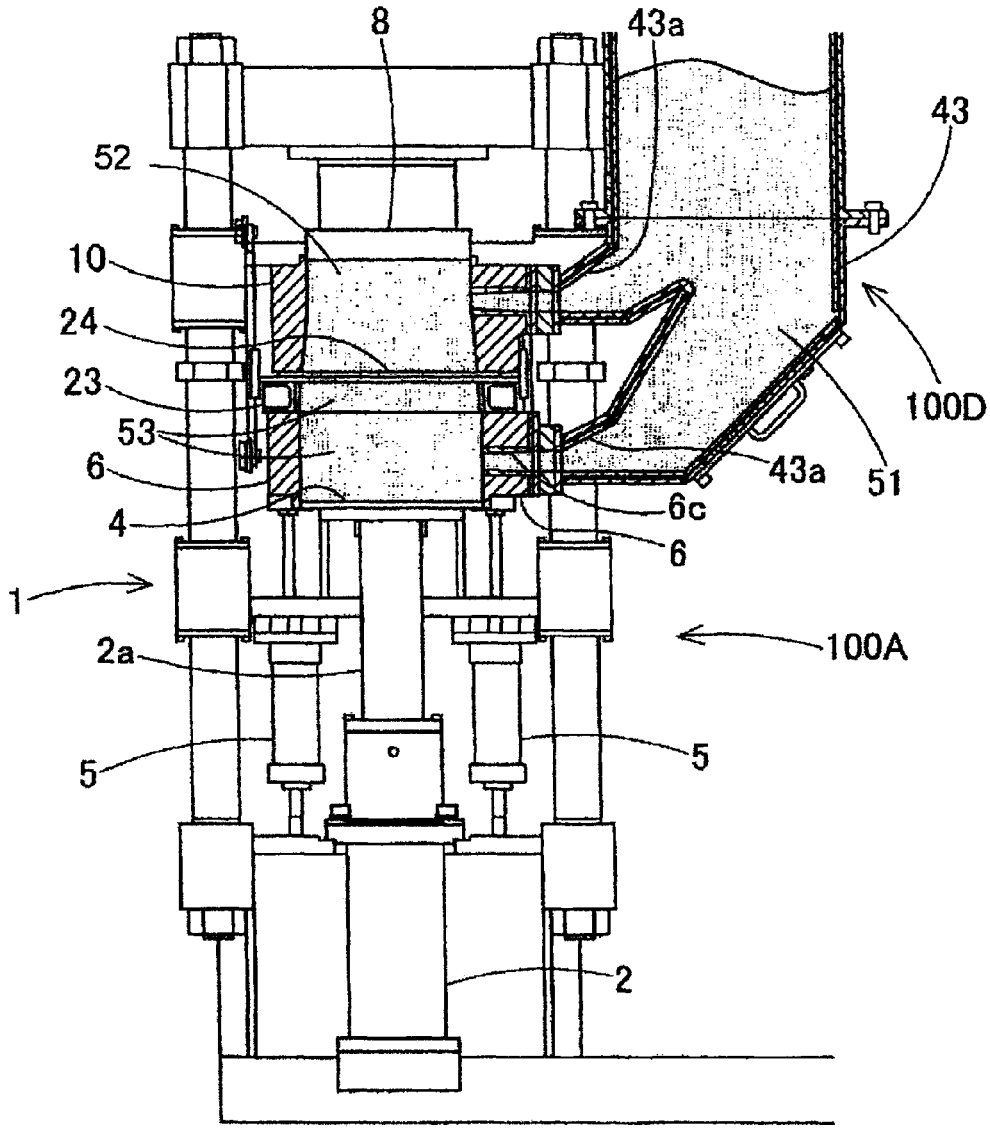
FIG. 10 is an illustration to explain the operations of the molding machine of FIG. 1 when the molding machine in FIG. 10 is in a state in which the step for filling a mold with molding sand of the molding process of the present invention of FIG. 8 (A) has just been completed.

(3) Step S2 of Setting the Flasks (FIG. 10)

In this step S2, the piston rod 2*a* of the flask-setting and squeezing cylinder 2 is upwardly extended to lift up the lower squeezing board 4, while the cylinder 5 of the lower filling frame is caused to raise the lower filling frame 6. The positioning pins 23 are then inserted in corresponding positioning holes (not shown) on the drag flask 23 so as to stack the lower filling frame 6 on the under surface of the drag flask 23. Therefore, a lower molding is defined and sealed by the lower squeezing board 4, the lower filling frame 6, the drag flask 23, and the matchplate 24. Because the lower squeezing plate 4 and the lower squeezing frame 3 constitute an integral structure, raising and lowering the flask-setting and squeezing cylinder 2 enables the lower squeezing board 3 to rise and lower together with the lower squeezing board 4.

The lower squeezing board 3 and the lower squeezing board 4 then ascend in unison, to insert the positioning pins 7 in the under surface of the cope flask 10 so as to stack the lower drag frame 23 on the under surface of the cope flask 10 through the matchplate 24 and the master plate 22. Therefore, an upper molding is defined and sealed by the upper squeezing board 8, the cope flask 6, and the matchplate 24. In defining the upper molding space, because an output of an advancing power required by a forward stroke of the flask-setting squeezing cylinder 2 can be made to just correspond to the weight of the construction to be lifted, the cylinder 2 may be a relatively low-pressure cylinder.

When the upper molding space is completely defined, the piston 2*a* of the flask-setting cylinder 2 has not yet reached the forward end (the upward end).

When the upper molding space is completely defined, the mold-sand introducing port 6*c* of the lower filling frame 6 is aligned with the one sand introducing port 43*a*.

Although FIG. 10 illustrates a state in which the molding sand 51 is filled in the upper molding space and the lower molding space, step S2 of setting the flasks is carried out before the molding sand 51 is filled in the upper and lower molding spaces.

(4) Step S3 of Filling the Sand (FIG. 10)

In step S3 of filling the sand, in the molding-sand supplying station 100 the sand gate 42 (FIG. 2) is closed, while compressed air is supplied to the aeration tank 43. The molding sand 51 is introduced in the lower molding space via the lowest of the sand introducing ports 43*a* and the molding sand introducing port 6*c* of the lower filling space, and is also introduced to the upper molding space via the uppermost of the sand introducing ports 43*a* and the molding sand introducing port 10*c* of the core flask 10.

In step S3 of filling the sand, only the compressed air is exhausted to the outside, through exhaust holes (not shown) that are provided on the sidewalls of the cope flask 10 and the drag flask 23.

Figure 11:
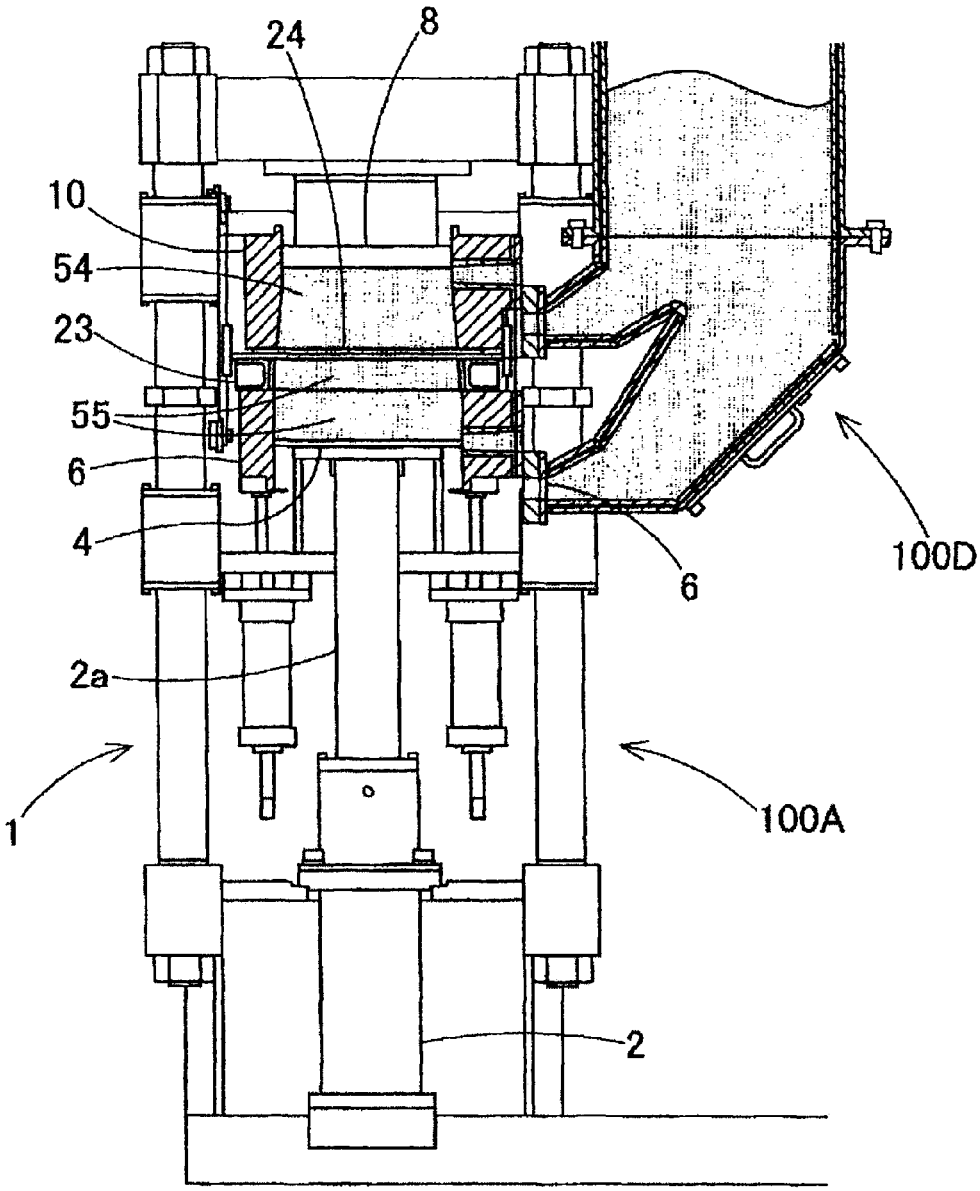
FIG. 11 is an illustration to explain the operations of the molding machine of FIG. 1 when the molding machine in FIG. 11 is in a state in which the step for squeezing molding sand in the molding process of the present invention of FIG. 8 (A) has just been completed.

(5) Step S4 for Squeezing the Molding Sand (FIG. 11)

In step S4 of squeezing the molding sand, the piston rod 2*a* of the flask-setting and squeezing cylinder 2 is further advanced such that the molding sand 52 in the upper molding space and molding sand 53 in the lower molding space are interleaved between the upper squeezing board 8 and the lower squeezing board 4 to squeeze the molding sand 52, 53. In this step S4, the lower filling frame 6, the drag frame 23, the matchplate 24, and the cope flask 10 all ascend in association with the ascent of the lower squeezing board 4. With step S4 for squeezing the molding sand, an upper mold 54 and a lower mold 55 are made.

When squeezing the molding sand, the booster cylinder 403 (FIG. 7) descends to supply hyperbaric high-pressure oil to the flask-setting and squeezing cylinder 2, to make the upper and lower molds each have the predetermined hardness. After the squeezing begins, the pressure switch PS (FIG. 7) determines the time to stop the descent of the booster cylinder 403. Preferably, the time to stop the pressure booster (i.e., the descent) of the booster cylinder 403 is set within the range of 0.1 MPa to 21 MPa. Because it is necessary to have equipment being able to withstand a pressure of more than 21 MPa when the range is over 21 MPa, this increases the cost. On the other hand, the hardness to form a mold could not be obtained when the pressure to be used was below 0.1 MPa.

In the present embodiment, from the initiation of the step of squeezing the molding sand, the booster cylinder 403 descends, while the flask-setting and squeezing cylinder 2 is operated at a high-pressure. Alternatively, in an initial stage of squeezing molding sand, the booster cylinder 403 is still deactivated, while the flask-setting and squeezing cylinder 2 is advanced (ascends). Following this, the booster cylinder 403 may be activated. Operating the flask-setting and squeezing cylinder 2 at the low pressure during the initial stage of the steps of squeezing molding sand can shorten the stroke in which the flask-setting and squeezing cylinder 2 squeezes at high-pressure. Thus the booster cylinder can be made more compact.

Figure 12:
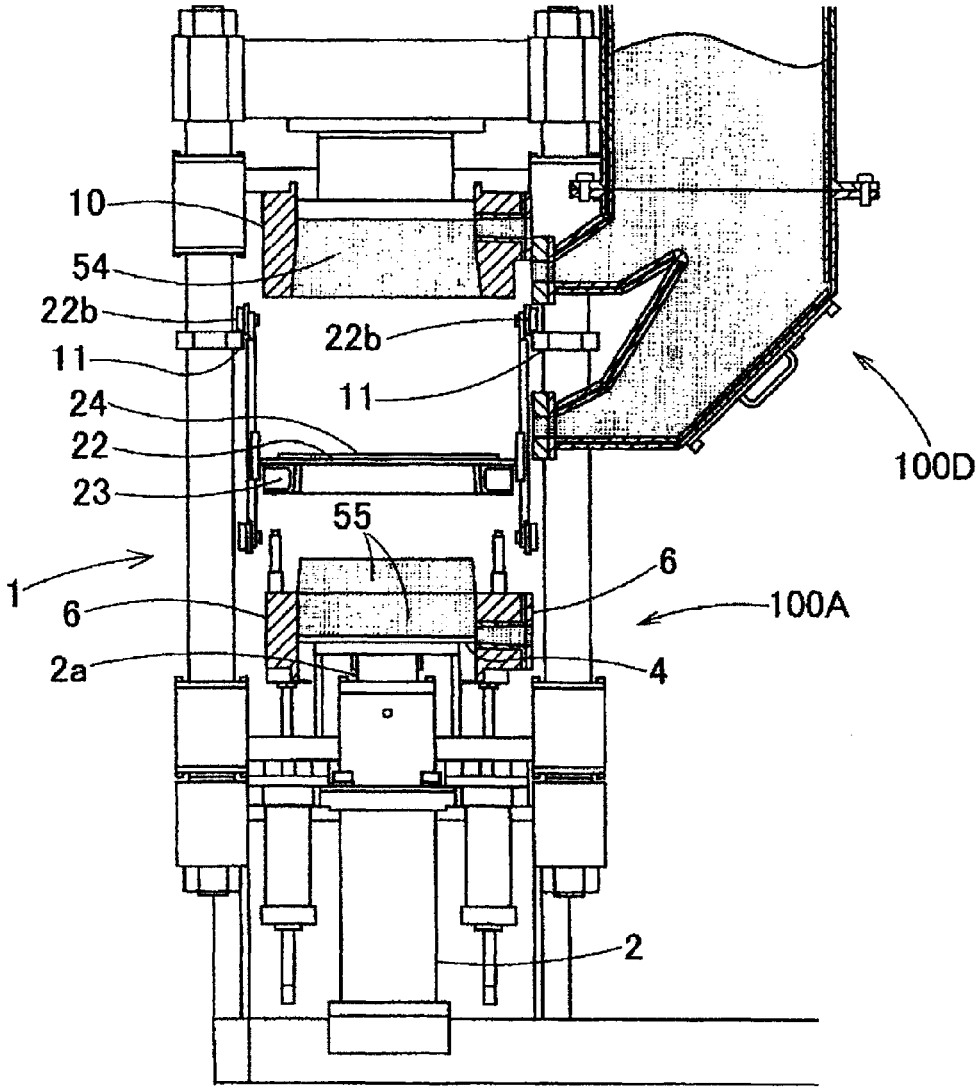
FIG. 12 is an illustration to explain the operations of the molding machine of FIG. 1 when the molding machine is in a state in which the step for removing ("drawing") the molds of the molding process of the present invention of FIG. 8 (A) has just been completed.

(6) Step 5 for Removing (Drawing) the Molds (FIG. 12)

In step 5, the piston rod 2*a* of the flask-setting and squeezing cylinder 2 is retracted, to thereby have the lower squeezing board 4 descend. In association with the descent of the lower squeezing board 4, the drag flask 23, the matchplate 24, the master plate 22, and the lower filling frame 6, also descend. In the middle of the descent, the four flanged rollers 22*b* above the master plate 22 ride on the pair of travelling rails 11 such that the descent of the master plate 22, the drag flask 23, and the matchplate 24 is stopped, while the lower squeezing board 4 and the lower filling frame 6 continuously descend.

When contracting the piston rod 2*a* of the frame-setting and squeezing cylinder 2, the pressure booster, i.e., the descent of the booster cylinder 403 (FIG. 7), is interrupted, to then ascend and operate the booster cylinder 403 at a low pressure. When drawing the molds from the matchplate, it is desirable to operate the frame-setting and squeezing cylinder 2 at a low velocity, to prevent the surfaces of the molds from collapsing.

Figure 13:
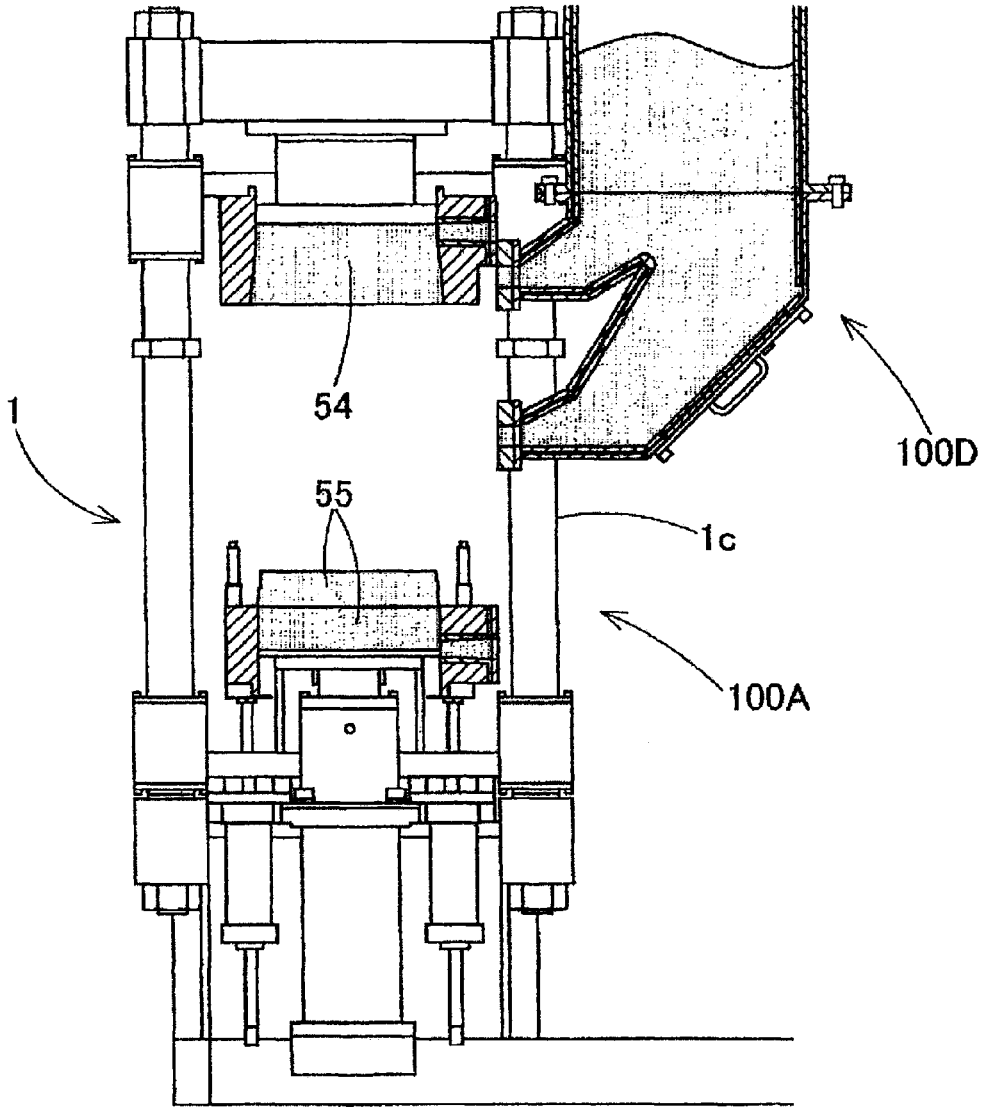
FIG. 13 is an illustration to explain the operations of the molding machine of FIG. 1 when the molding machine in FIG. 13 is in a state in which the step for shuttling out the patterns of the molding process of the present invention of FIG. 8 (A) has just been completed.

(7) Step S6 of the Pattern Shuttle-Out (FIG. 13)

In step S6 of the pattern shuttle-out, the master plate 22 is coupled to the distal end of the piston rod 2 of the pattern-shuttle cylinder 21, when the four flanged rollers 22*b* above the master plate 22 ride on the pair of the travelling rollers 11 in step S5 of removing (drawing) the molds.

In step S6 of the pattern shuttle-out, the piston rod 21*a* of the pattern-shuttle cylinder 21 is retracted to its retracted end position. In association with the retraction of the piston rod 21*a*, the four flanged rollers 22*b* beneath the master plate ride on the pair of the guide rails 25, while the two left flanged rollers 22*b* of the four flanged rollers 22*b* above the master plate 22 are separated from the pair of the traveling rails 11. The master plate 22, the drag flask 23, and the matchplate 24 are returned to their retracted end positions (initial positions).

After step S6 of the pattern shuttle-out is completed, each core may be set inside the corresponding column 1*c*, if necessary. However, setting the core is not always required by the present invention.

Figure 14:
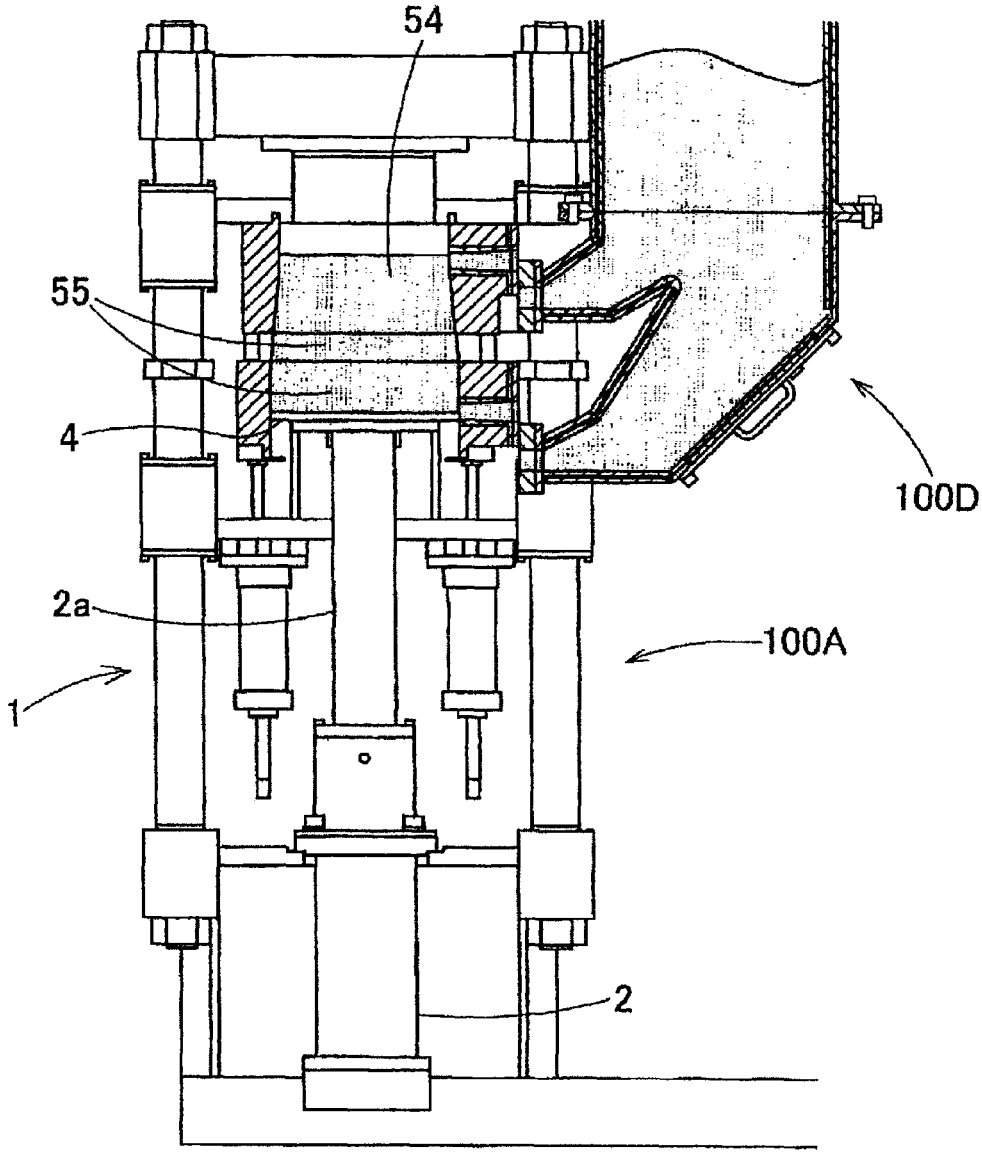
FIG. 14 is an illustration to explain the operations of the molding machine of FIG. 1 when the molding machine in FIG. 14 is in a state in which the step for stacking the molds during the molding process of the present invention of FIG. 8 (A) has just been completed.

(8) Step S7 of Stacking the Molds (FIG. 14)

In step S7 of stacking the molds, the piston rod 2*a* of the flask-setting and squeezing cylinder 2 is advanced to raise the lower squeezing board 4 such that the lower mold 55 is in close contact with the under surface of the upper mold 54.

The advancing of the flask-setting and squeezing cylinder 2 in step 7, similar to step S2 of setting the flasks, is carried out under low pressure, while the booster cylinder is still stopped. It is preferable that the flask-setting and squeezing cylinder 2 be activated at the low pressure immediately prior to the upper mold 54 and the lower mold 55 being in close contact with each other, to prevent the respective molds from being collapsed by a shock generated by the close contact therebetween.

Figure 15:
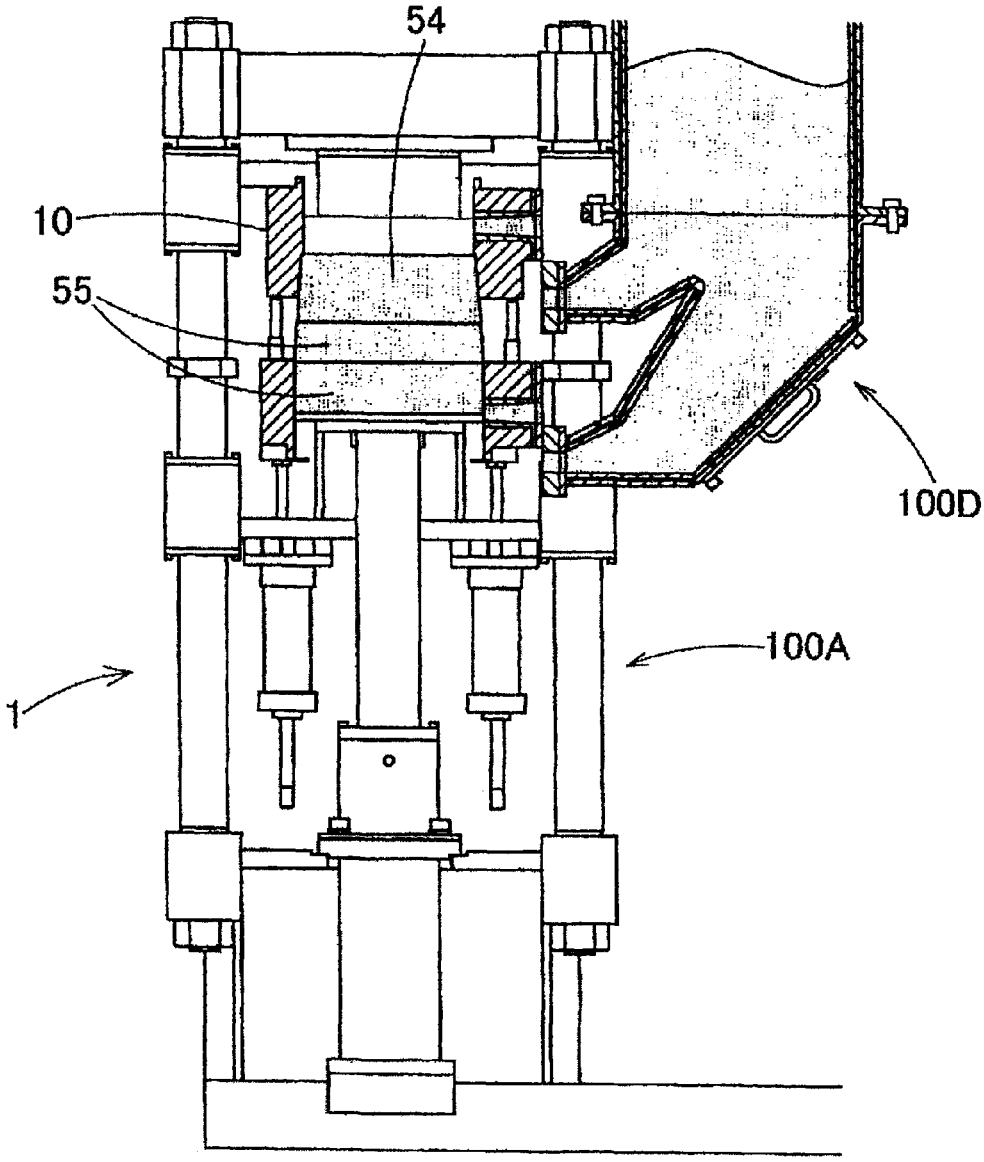
FIG. 15 is an illustration to explain the operations of the molding machine of FIG. 1 when the molding machine in FIG. 15 is in a state in which an upper molding is being drawn from a cope flask in a step for stripping the flasks.
Figure 16:
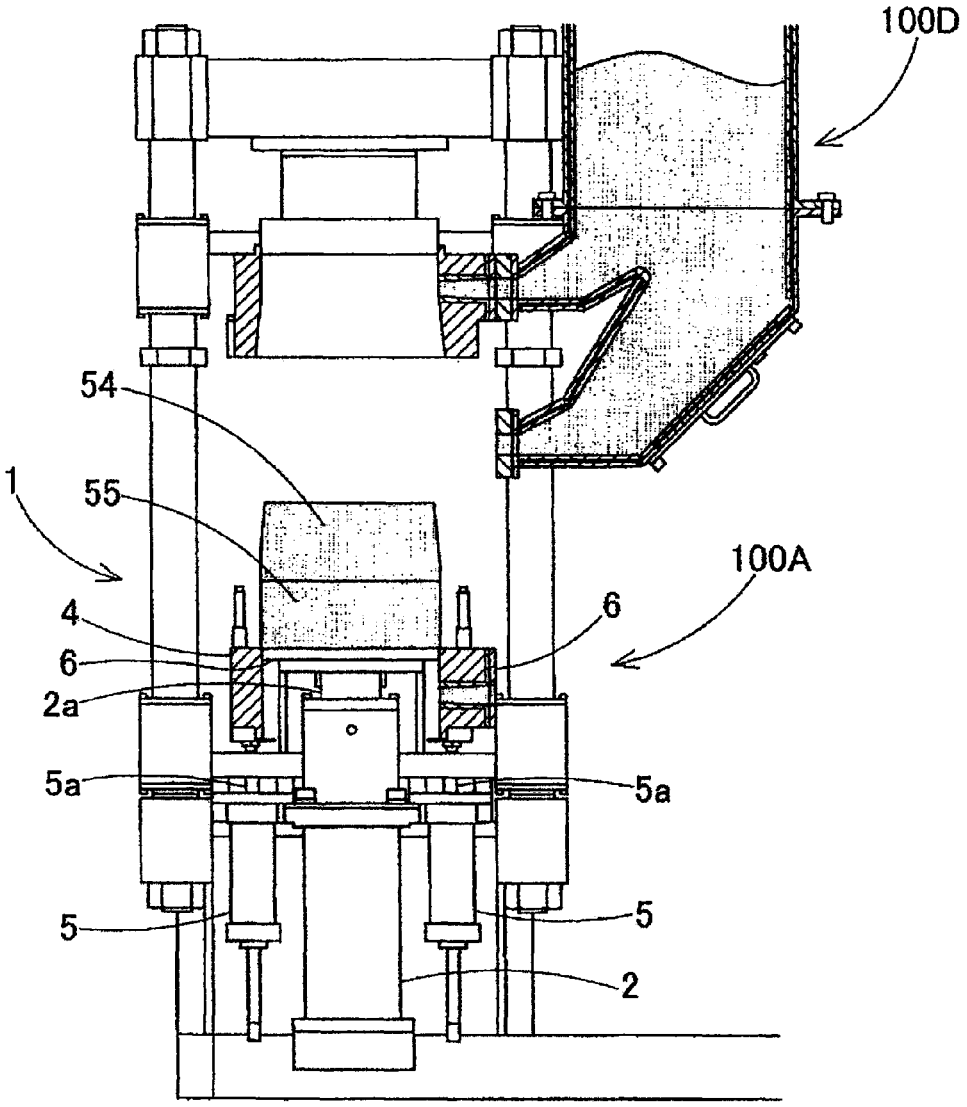
FIG. 16 is an illustration to explain the operations of the molding machine of FIG. 1 when the molding machine in FIG. 16 is in a state in which the step for stripping the flasks has just been completed.

(9) Step S8 of Striping the Flasks (FIGS. 15 and 16)

In step S8 of striping the flasks, as illustrated in FIG. 15, retracting the piston rods 9*a* of the cylinder 9 of the cope flask causes the cope flask 10 to ascend. In association with the ascension of the cope flask 10, the upper mold is stripped from the cope flask 10. After this stripping, advancing the piston rod 9*a* of the cylinder 9 of the cope flask causes the cope flask 10 to return to its lowered end position, i.e., its initial position.

Then, the piston rod 2*a* of the flask-setting and squeezing cylinder 2 is retracted to return the squeezing board 4 to its lowered end position, i.e., its initial position. Also, as illustrated in FIG. 16, retracting the upper piston rod 5*a* of the cylinder 5 of the lower filling frame causes the lower filling frame to return to its lowered end position, i.e., its initial position.

The advancing of the flask-setting and squeezing cylinder 2 in step 8, similar to step S7 of stacking the molds, is carried out under low pressure, while the booster cylinder is still stopped. It is preferable that the flask-setting and squeezing cylinder 2 be activated at the low velocity immediately prior to reaching its lowered end position, to prevent the respective stripped molds from suffering a shock.

(10) Step S9 of Pushing Out the Molds

In step S9 of pushing out the molds, the piston rod 31*a* of the pushing cylinder 31 for pushing out the molds to advance the pushing plate 32 is advanced such that the molds (the upper and lower molds) on the lower squeezing board 4 are pushed out in a carrying line.

Thereafter, the piston rod 31*a* is retracted such that it is returned to its initial position.

Step S2 of setting the flasks, step S5 of removing (drawing) the molds, step S7 of stacking the molds, and step S8 of stripping the flasks, outputs required to advance or retract the flask-setting and squeezing the cylinder 2 at the low pressures, are preferably in a range of from 0.1 MPa to 0.6 MPa. The driving mechanism 400 of the flask-setting and squeezing cylinder employs the air-on-oil system described above.

In a typical molding company, the pressure supplied by the compressed-air source 401 may be set at about 0.6 MPa. Although it is possible to use a pressure of more than 0.6 MPa, to do so it is necessary to improve the performance of the compressor. Therefore, it is preferable to use a pressure that is 0.6 MPa or less, to save energy. Further, it is difficult to drive the flask-setting and squeezing cylinder 2 under a pressure that is lower than 0.6 MPa, due to the total weight of the objects to be drive and the frictional resistance of a packing material, and so on, within the cylinder.

The advancing and retracting of the piston rod 21*a* of the pattern-shuttle cylinder 21 is carried out under a pneumatic pressure of a range from 0.1 MPa to 0.6 MPa. As described above, in the typical molding firm, the pressure supplied by the compressed-air source 401 may at about 0.6 MPa, and the pneumatic pressure to activate the pattern-shuttle cylinder 21 is preferably equal to 0.6 MPa or less, as an energy-saving objective. Further, it is difficult to drive the pattern-shuttle cylinder 21 under a pressure that is lower than 0.1 MPa, due to the total weight of objects to be driven and the frictional resistances of a packing material and so on within the cylinder.

In this embodiment, the pattern-shuttle cylinder 21 is an air cylinder. Alternatively, the pattern-shuttle cylinder 21 may be an electric cylinder. If the pattern-shuttle cylinder 21 is an electric cylinder, the molding machine has a simpler construction, since no pneumatic piping for the cylinder 21 is necessary.

Pneumatic pressures to advance (raise) and retract (lower) the cylinder 5 of the lower filling frame may only be within a range from 0.1 MPa to 0.6 MPa. The cylinder 5 of the lower filling frame can be activated at pneumatic pressures from 0.1 MPa to 0.6 MPa, since it is used to lift up the lower filling frame 6, the drag flask 23, and the matchplate 24, and is used to remove the lower mold from the lower filling frame 6. Because, in the typical foundry company, the pressure supplied by the compressed-air source 401 may be at an order of 0.6 MPa, the pneumatic pressure to drive the cylinder 5 of the lower filling frame is preferably 0.6 MPa or less, as an energy-saving objective. Further, it is difficult to drive the cylinder 5 of the lower filling frame under a pressure that is lower than 0.1 MPa, due to the total weight of objects to be lifted up and the frictional resistance of a packing material and so on within the cylinder.

As described above, by the molding process of this embodiment, the driving mechanism 400 of the flask-setting and squeezing cylinder utilizes a hybrid circuit. It includes a pneumatic circuit and a hydraulic circuit, with a scheme of an air-on-oil system (a driving scheme for transforming a pneumatic low-pressure into a hydraulic high-pressure to be used). With this scheme, the upper mold and the lower mold can be simultaneously made by using a squeezing mechanism that can generate a high power output by supplying only pneumatic pressure. Thus, the squeezing mechanism can be readily maintained and compacted.

The flask-setting and squeezing cylinder 2 is activated by the scheme of the air-on-oil system by means of the hybrids circuit that includes the pneumatic circuit and the hydraulic circuit. Because such a flask-setting and squeezing cylinder 2 is used in the most important steps for making the molds, i.e., step S4 of squeezing the molding sand and step S2 of setting the flasks, as well as step S5 for removing the molds and step S7 of stacking the molds, high-quality molds can be provided in the optimum time.

A pneumatic cylinder, which is activated by air having a high compaction property, is not suitable to the two (or more)-velocity controls, since its velocity cannot be rapidly changed under a switching control in velocity. In contrast, because a hydraulic cylinder that is activated by a liquid having a very low compaction property immediately responds in velocity to the switching control, it readily uses the two (or more)-velocity controls. Operating the pneumatic cylinder at one low velocity requires a significant time to make the molds. Adversely, operating the pneumatic cylinder at one high velocity may result in defective molds in which, for instance, a part of a mold collapses in the step of removing the molds, or a mold is collapsed by a shock in the step of stacking the molds. In contrast, using the hydraulic cylinder with an operational plan of the air-on-oil system under the two-velocity controls overcomes both the problem of the operating time and that of the defective molds, and provides high-quality molds in the optimum time.

The molding process of this embodiment can obtain an output power that equals hydraulic pressure, by using only pneumatic pressure, without using a dedicated hydraulic unit. In addition, booster equipment can be compacted, since it boosts the pressure at just the time when a high-output power is necessary. Furthermore, because the molding process of this embodiment utilizes no hydraulic unit having a hydraulic pump, the cost required for a component to be replaced in maintenance can be reduced, and an operator needs little knowledge of hydraulic pressure or hydraulic equipment. In addition, because no piping-installation personnel who specialize in hydraulic pressure are required to install and assemble the molding machine on site, the cost of the installation of it can also be reduced.

Furthermore, the molding process of this embodiment can utilize and maximize the above squeezing mechanism such that only supplying pneumatic pressures and electricity enables a simultaneous making of the molds. Because arrangements of valves in locations in relation to the air-on-oil system are confined almost exclusively to pneumatic valves, an operator can handle them with only knowledge of pneumatic pressure. Compared to a hydraulic valve, a pneumatic valve is light weight, and can be readily handled. Because almost all of the piping is also constituted of pneumatic piping, the operator can readily handle its maintenance.

In the molding process of this embodiment, the flask-setting and squeezing cylinder 2 is activated at a low pressure in step S2 of setting the flasks, step S7 of stacking the molds, and step S8 of stripping the flask, while the booster cylinder is activated only in step S4 of squeezing the molding sand, which step S4 requires high pressure. Therefore, the size of the booster cylinder can be compacted, compared with the length of the operating strokes of the flask-setting and squeezing cylinder 2.

Because the pressure switch is located in the hydraulic piping to monitor the timing to interrupt the booster cylinder, using the same squeezing force with each cycle can make and provide molds with a stable quality.

In the molding process of the embodiment, because the pattern-shuttle cylinder 21 and the cylinder 5 of the lower filling frame are activated by pneumatic pressures, the hydraulic piping need not be complicated.

In the embodiment, although supplying the molding sand utilizes the aeration, instead of it a blowing may be utilized. As used herein, the term "aeration" refers to a method for supplying the molding sand with a pneumatic low-pressure, i.e., a range from 0.05 MPa to 0.18 MPa. The term "blowing" refers to a method for supplying the molding sand with a pneumatic high-pressure, i.e., a range from 0.2 MPa to 0.35 MPa.

As described above, in the molding machine 100 and the molding process of the present invention, the driving mechanism 400 for driving the flask-set and squeeze cylinder to raise or lower the lower squeezing board using an air-on-oil system and its associated components are provided such that the driving mechanism 400 can be adequately controlled to simultaneously make the upper mold and the lower mold by supplying just the pneumatic pressure to generate a high pressure. Further, the step of squeezing the molding sand can be operated with an optimum timing to control the air-on-oil system to enable adequate operations of the lower squeezing board and its associated components in conformity with the respective steps. The molding machine 100 thus provides a simplified and compact configuration, and an ease of maintainability to make high-quality molds without any defective mold product, for instance, a failure due to removing the mold. Because the mold machine 100, in particular, utilizes the pneumatic pressure and the booster cylinder to increase the pneumatic pressures and to transform the increased pneumatic pressures into hydraulic high-pressures, no dedicated hydraulic unit can be required. Thus also booster equipment that boosts pressure only when high pressure is required can be made compact. Therefore, the molding machine can be made compact beyond conventional possibilities. Further, because the molding machine 100 omits the hydraulic unit, the configuration of a controlling means such as a sequencer can itself be significantly simplified. Thus the molding machine 100 can be made compact at a low cost. In particular, in the molding machine 100, a circuit breaker and a magnet switch, which constitute circuitries for driving, e.g., a hydraulic pump, can be omitted. Thus the configuration of a controlling means can itself be significantly simplified.

In the use of a pneumatic cylinder, because air is fluid and has a high compaction property, it cannot rapidly change in velocity under a switching control. Thus it cannot be suitable with two (or more)-velocity controls. However, applying such a control to a hydraulic cylinder may overcome both the problem of the operation time and the problem of the failure due to removing the mold. Because the liquid in the hydraulic cylinder has a very low compaction property, the hydraulic cylinder can immediately respond to the switching control for velocity to readily use the two (or more)-velocity control.

Although the molding machine 100 of the first embodiment of the present invention is explained using the driving mechanism 400, instead of it, a driving mechanism 500, which is described in the second embodiment, can be used.

In the molding machine 100 and the molding process of the present invention, the flask-setting and squeezing cylinder utilizes the air pressure and the booster cylinder, to increase the air pressure and to transform the increased air pressure into hydraulic high-pressure, such that the flask-setting and squeezing cylinder is activated with the optimum timing. Because an excellent mold is an essential tool to make an excellent molded product, the most important steps for making molds are the step of squeezing the molding sand and the step of setting the flasks. Therefore, in the molding machine 100 and the molding process of the present invention, the step of squeezing the molding sand and the step of setting the flasks, as well as the step of removing the molds and the step of stacking the molds, are operated by using the flask-setting and squeezing cylinder.

The molding machine 100 and the molding process of the present invention can obtain an output power that equals hydraulic pressure by using just the pneumatic pressure, and without using a dedicated hydraulic unit. Booster equipment can be made compact, since it boosts the pressure at just the time when a high-output power is necessary. They utilize no hydraulic unit having a hydraulic pump, the cost required of a component replacement in maintenance can be reduced, and the operator needs little knowledge of hydraulic pressure or hydraulic equipment. In addition, because no piping-installation personnel who specialize in hydraulic pressure are required to install and assemble the molding machine on site, the cost of installation of it can also be reduced.

Furthermore, the molding machine 100 and the molding process of the present invention can utilize and maximize the above squeezing mechanism such that just supplying pneumatic pressures and electricity enables a simultaneous making of the molds. In comparison to a hydraulic valve, a pneumatic valve is light weight and can readily be handled. Because arrangements of valves in locations in relation to the air-on-oil system are confined almost exclusively to pneumatic valves, the operator can handle them with only knowledge of pneumatic pressure. Because almost all the piping is also constituted by pneumatic piping, the operator can readily maintain it with simple handling of it.

Because in the mechanism disclosed in Patent Literature 2 the piping system and the arrangements of valves are complicated, there are problems in that to assemble and install them takes a long time, even if service personnel have technical expert knowledge and experience. In particular, recently a mainstream design of a molding machine for drawing flasks squeezes the molding sand at a high pressure. The maximum squeezing pressure on a unit area is 1.0 MPa. Under a pressure of 0.6 MPa, maintaining a necessary output for a mold having a pattern plan 450 mm or more long and 350 mm wide necessitates a pneumatic cylinder having a diameter of about 600 mm. Therefore, it results in larger equipment, and the initial cost is further increased.

In the molding machine 100 and the molding process of the present invention, the step of defining the lower molding space and defining the upper molding space can be carried out by operating the flask-setting and squeezing cylinder at low pressure. The low pressure to activate the flask-setting and squeezing cylinder may range, for instance, from 0.1 MPa to 0.6 MPa. The stroke length of the flask-setting and squeezing cylinder for the step of setting the flask is more than three times that for the step of squeezing the molding sand. Therefore, although the flask-setting and squeezing cylinder is activated by transforming pneumatic low-pressure into hydraulic low-pressure, there is no necessity to use the booster cylinder. Thus the booster cylinder can be made compact.

In the step of raising the lower squeezing board to squeezing the molding sand so as to simultaneously make the upper mold and the lower mold, the flask-setting and squeezing cylinder can be activated at a high pressure by means of the booster cylinder so as to squeeze the molding sand.

Because the step of operating the flask-setting and squeezing cylinder at high pressure by means of the booster cylinder is carried out by the same cylinder that is used in the step of setting the flasks, the squeezing mechanism can be simplified, rather than being complicated. Because the booster cylinder is activated only when high pressure is necessary, the size of it can be made compact.

Further, after the beginning of the squeezing of the molding sand, the pressure switch in the hydraulic piping can determine a timing to stop the booster cylinder, when the pressure switch detects that the hydraulic pressure in the hydraulic piping reaches the predetermined range, i.e., from 0.1 MPa to 21 MPa.

By providing the pressure switch in the hydraulic piping, whether hydraulic pressure in the hydraulic piping reaches the predetermined range from 0.1 MPa to 21 MPa can be monitored. Therefore, using the same squeezing force with each cycle can make and provide molds with a stable quality. Otherwise, to monitor the pressure, different squeezing forces with each cycle are used to make molds that involve significant variations in their strengths and thus the molding products may have significant variations in the accuracy of their dimensions.

In the step of drawing the upper mold from the pattern on the upper surface of the matchplate and of drawing the lower mold from the pattern on the lower surface of the matchplate, the flask-setting and squeezing cylinder can be lowered at a lower pressure to stack the molds, while the booster cylinder is inactivated. Thus, there is a merit in which the size of the booster cylinder can be made compact, for the same reason as for the step of setting the flasks.

In the molding machine 100 and the molding process, following by the step of drawing the upper mold from the pattern on the upper surface of the matchplate and of drawing the lower mold from the pattern on the lower surface of the matchplate, it is preferable that the flask-setting and squeezing cylinder ascend at a lower pressure to stack the molds, while the booster cylinder is inactivated.

In this way, because the molds can be stacked at a low pressure, there is a merit in that this prevents the molds from collapsing. To stack the molds at a high pressure without collapsing them, it is necessary to use some mechanical means for preventing the molds from collapsing, or to provide a piping system in which pressure is regulated by means of a decompression valve. This results in increased costs.

The molding machine 100 and the molding process, followed by the step of stacking the molds, may further carry out the step of stripping the upper mold from the cope flask, and the step of stripping the lower mold from the lower filling frame, by lowering the flask-setting and squeezing cylinder at a low pressure, while the booster cylinder is inactivated.

Followed by the step of stacking the molds, because lowering the flask-setting and squeezing cylinder can be carried out under the low pressure, while the booster cylinder is inactivated, there is a merit in which the size of the booster cylinder can be made compact, for the same reason as for the step of setting the flasks.

Further, in one embodiment of the molding machine 100 and the molding process of the present invention, the patterns are actuated by means of the pattern-shuttle cylinder that can be activated by pneumatic pressure of a range from 0.1 MPa to 0.6 MPa. Alternatively, the patterns may be actuated by means of an electric cylinder.

Because the pattern can be actuated by pneumatic pressure in these arrangements, there is a merit in that hydraulic piping can be simplified.

Alternatively, in the molding machine 100 and the molding process, the lower filling frame may be activated by a pneumatic pressure of a range from 0.1 MPa to 0.6 MPa. In this case, there is a merit in that the hydraulic piping can be simplified.

2. The Second Embodiment

The molding machine and the molding process of the second embodiment of the present invention will now be explained by reference to FIG. 17. In the second embodiment, first a preferred driving mechanism for use with a flask-setting cylinder of the molding machine will be explained. Also, the molding machine employing that driving mechanism will be explained.

Figure 17:
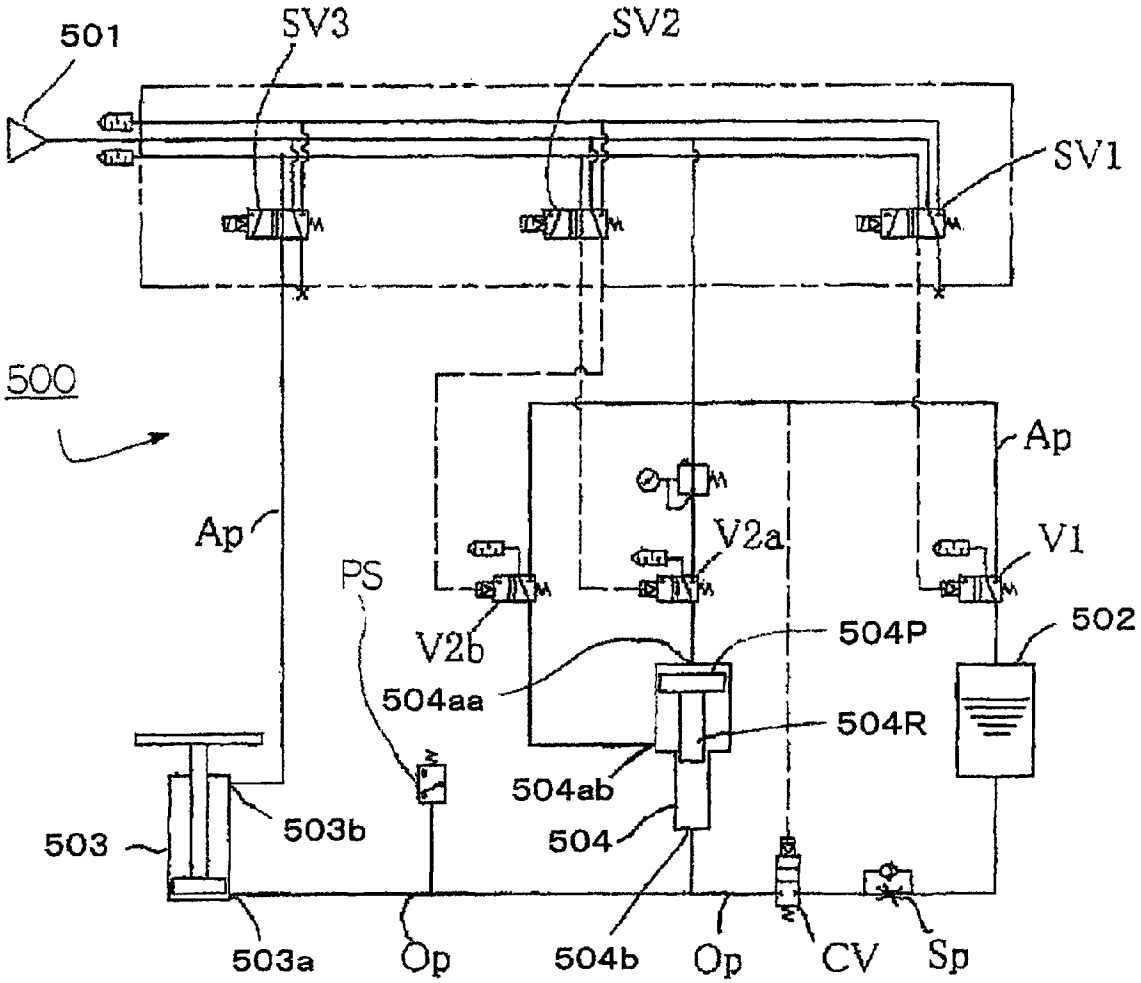
FIG. 17 is a schematic piping and instrumentation diagram of one example of the driving mechanism of the molding machine of the second embodiment of the present invention.

In FIG. 17, a driving mechanism 500, used in the molding machine of the second embodiment, includes a compressed-air source, a hydraulic oil tank in which one end is coupled to the hydraulic oil tank to establish a fluid communication and a cutoff therebetween, a flask-setting and squeezing cylinder having a return port that is coupled to the compressed-air source to establish a fluid communication and a cutoff therebetween and an inlet port that is coupled to the hydraulic oil tank via a hydraulic piping to establish a fluid communication and a cutoff therebetween, and a booster cylinder having an inlet port and a return port that are coupled to the compressed-air source. The booster cylinder normally and fluidly communicates with the flask-setting and squeezing cylinder via the hydraulic piping.

As used herein, the term "compressed-air source" refers to an air source for taking in or generating compressed air by means of, for instance, an external piping, a compressed-air tank, or a compressor. Typically, any compressed air piping system in a factory may be used as the compressed-air source.

The wording "a hydraulic oil tank in which one end is coupled to the hydraulic oil tank to establish a fluid communication and a cutoff therebetween" refers to a hydraulic oil tank whose upper portion is coupled to, for instance, via a valve, the compressed-air source, to establish a fluid communication and a cutoff therebetween. Therefore, the surface of the hydraulic oil within the hydraulic oil tank can be pressurized by compressed air. But the pressurizing of the surface of the hydraulic oil can be harmfully interrupted by exhausting the compressed air from the hydraulic oil tank.

The wording "a flask-setting and squeezing cylinder having a return port that is coupled to the compressed-air source to establish a fluid communication and a cutoff therebetween and an inlet port that is coupled to the hydraulic oil tank via a hydraulic piping to establish a fluid-communication and a cutoff therebetween" refers to a cylinder that can be used for setting the flasks and for squeezing the molding sand. This cylinder carries out the step of setting the flasks under hydraulic low-pressure, by having a fluid communication between it and the hydraulic oil tank. Further, this cylinder carries out the step of squeezing the molding sand under hydraulic high-pressure, by cutting off the fluid communication between it and the hydraulic oil tank and generating the hydraulic high-pressure by means of a booster cylinder (described below).

The wording "a booster cylinder having an inlet port and a return port that are coupled to the compressed-air source, and that normally and fluidly communicates with the flask-setting and squeezing cylinder via the hydraulic piping," refers to a booster cylinder that utilizes Pascal's principle and has a hybrid system that includes a pneumatic system and a hydraulic system such that its function transforms pneumatic low-pressure into hydraulic high-pressure. Such an air-on-oil system needs no hydraulic pump, but uses just a pneumatic-pressure source.

In the flaskless molding machine of the second embodiment, the flask-setting and squeezing cylinder utilizes the air-on-oil system. In the flaskless molding machine of the second embodiment, the expressions "the lower filling frame is configured such that the lower filling frame can be raised independently from and simultaneously with—the lower squeezing board" also refers to conditions, as described above, in which independent of the lower squeezing board, only the lower filling frame is raised by a cylinder of the lower filling frame, while the lower squeezing board is raised by the flask-setting and squeezing cylinder, and the lower filling frame can be raised simultaneously with the lower squeezing board.

The "molding sand" of the second embodiment does not denote the types of it. For instance, green sand using bentonite as a bonding agent may be preferred.

3. A Piping System of the Driving Mechanism of the Second Embodiment

The piping system of the driving mechanism 500 of the second embodiment will now be explained by further reference to FIG. 17, in which the piping system is schematically illustrated. The driving mechanism illustrated in FIG. 17 includes a compressed-air source 501, a hydraulic oil tank 502, a flask-setting and squeezing cylinder 503, and a booster cylinder 504.

In FIG. 17, the compressed-air source 501 is a source for taking in or generating compressed air. One end of the upper part of the hydraulic oil tank 502 is coupled to the compressed-air source 501 to selectively establish a fluid communication and a cutoff therebetween, through a pneumatic piping Ap. Provided to enable the fluid communication and the cutoff are a solenoid valve SV1 and a valve V1, which can be activated by the solenoid valve SV1. The lower portion of the hydraulic oil tank 502 is coupled to one port (an inlet port) 503*a* of the flask-setting and squeezing cylinder 503 to selectively establish a fluid communication and a cutoff therebetween, through the pneumatic piping. The other port (a return port) 503*b* is coupled to the compressed-air source 501 to selectively establish a fluid communication and a cutoff therebetween, through the pneumatic piping Ap.

On the booster cylinder 504, a port (an inlet port) 504*aa* and a port (a return port) 504*ab* thereof are coupled to the compressed-air source 501 to selectively establish a fluid communication and a cutoff therebetween. Further, a port 504*b* of the booster cylinder 504 is coupled to the hydraulic oil tank 502 to selectively establish a fluid communication and a cutoff therebetween, through a hydraulic piping Op and a cutoff valve CV. Assuming the ratio of the closed section of the piston 504P to the rod 504R of the booster cylinder 504 is 10:1, the booster cylinder 504 can transform compressed air pressure into hydraulic power that has a hydraulic pressure ten times that of the compressed air pressure. Provided between the hydraulic oil tank 502 and the cutoff valve CV is a speed controller Sp.

Further, the port 504*b* of the booster cylinder 504 is coupled to the flask setting and squeezing cylinder 503 to constantly establish a fluid communication therebetween, thorough the hydraulic piping Op. At least two of the solenoid valve SV1, a solenoid valve SV2, and a solenoid valve SV3, are integrally coupled to the compressed air source 501 through a manifold.

Below the operation of the driving mechanism 500 of the flaskless molding machine of the second embodiment will be explained. In FIG. 17, the flask-setting and squeezing cylinder 503 first carries out the step of setting the cope flask and the drag flask of the flaskless molding machine. Thereafter, the flask-setting and squeezing cylinder 503 is used to squeeze the molding sand at a high pressure. The flask-setting and squeezing cylinder 503 first sets the flasks. In a start up of the step for setting the flasks, the solenoid valve SV1 is activated and opened to open the valve V1. Simultaneously, the cutoff valve CV is opened. The resulting compressed-air pressure causes hydraulic oil to be supplied from the hydraulic oil tank 502 to the flask-setting and squeezing cylinder 503. When the step of setting the flasks is completed, the valve V1 and the cutoff valve CV are closed, to maintain the set flasks. The interiors of the flasks (not shown) are then filled with molding sand and thus the step of filling the molding sand is completed. By the steps described above, the flaskless molding machine is operated under the normal pressure.

Thereafter, valves V2*a* and V2*b* are operated by activating the solenoid valve SV2 such that compressed air operates the booster cylinder 504. The booster cylinder 504, if the ratio of the closed sections of the piston 4P to the rod 4R is 10:1, can transform pneumatic pressure into hydraulic pressure having ten times the pressure of the input pneumatic pressure. For instance, a pressure switch PS may be provided to check that the pressure of the hydraulic oil is achieved at a predetermined pressure.

After the step of squeezing the molds is completed, the solenoid valve SV3 is opened as a process of a transition to the step of drawing the molds, to be carried out by compressed-air pressure. Simultaneously, the solenoid valve SV1 is opened to open the valve V1. The used hydraulic oil returns to the hydraulic oil tank 502 by opening the valve V1 and the cutoff valve CV. Because the flask-setting and squeezing cylinder 503 lifts heavy loads, such as the squeezing frame and the flasks, their own weights can cause the flask-setting and squeezing cylinder 503 to contract. Therefore, the solenoid valve SV3 is not indispensable.

The step of striping the flasks can be carried out under lower pressure. Therefore, the valve V1 is opened by opening the solenoid valve SV1 such that the flask-setting and squeezing cylinder 503 can be operated by only compressed-air pressure.

As just described, at least two of the solenoid valve SV1, the solenoid valve SV2, and the solenoid valve SV3 are integrally coupled to the compressed-air source 1 through the manifold. This results in sand-casting equipment having the driving mechanism described above can be readily installed, operated, and maintained.

Although the step of squeezing the molding sand in the second embodiment, which step is carried out by squeezing the molding sand from underneath, may also be carried out by squeezing the molding sand from above, or from both above and underneath.

If a large cylinder or the air-on-oil system in which a booster cylinder boosts pressure is used, it is possible to reverse the flasks. As used herein, the term "reverse the flasks" refers to reversing the flasks in order to fill them with the molding sand that is supplied from above, rather than in order to carry out the step of laterally squeezing the molding sand.

As described above, in the molding machine 100 of the first embodiment (FIGS. 1-16), the driving mechanism 400 of it may be replaced with the driving mechanism 500 as illustrated in FIG. 17.

Figure 18:
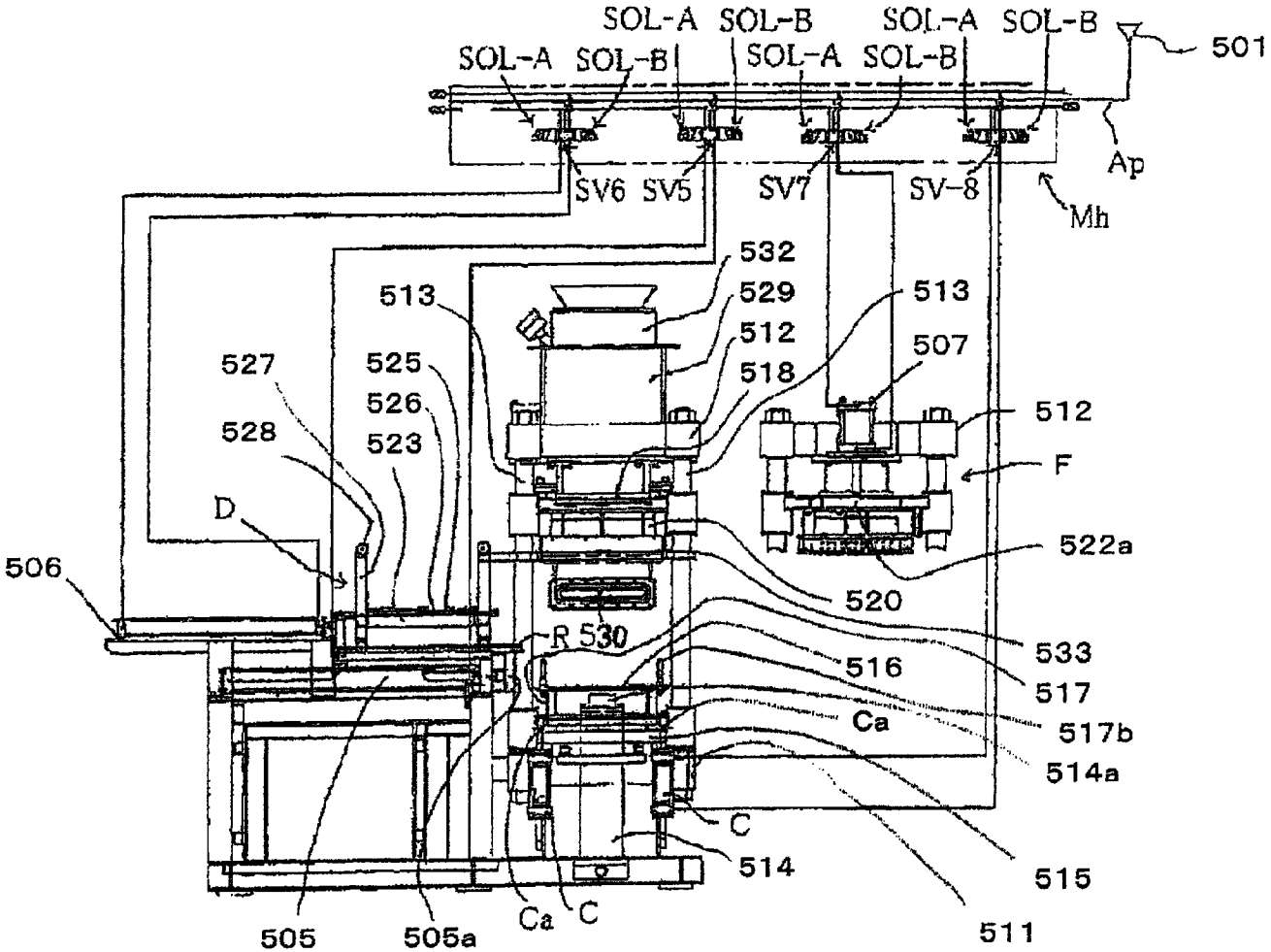
FIG. 18 is a side view of the molding machine of the third embodiment of the present invention and partially illustrates its piping system.

4. The Driving Mechanism of the Flaskless Molding Machine of the Third Embodiment The third embodiment of the present invention will now be explained. FIG. 18 is a side view, which includes a partial front view of the flaskless molding machine of the third embodiment of the present invention. In FIG. 18, a piping system is schematically illustrated to present only a part of the pneumatic piping. On the flaskless molding machine of the third embodiment of the present invention, first, the driving mechanism of it will be explained. In the driving mechanism in FIG. 18, a constitutive part of driving a flask-setting and squeezing cylinder 3 may similarly constitute that of the driving mechanism 500, as illustrated in FIG. 17 and as described above. Thus, the constitutive part is omitted illustration in FIG. 18. In the flaskless molding machine used as sand casting equipment (hereinafter, "the flaskless molding machine") in FIG. 18, the driving mechanism includes a compressed-air source 501. Solenoid valves SV5-SV8, utilizing pneumatic pressure, are integrally coupled to the compressed-air source 501 through a manifold Mh.

The solenoid valve SV5 couples the compressed-air source 501 to a pushing cylinder 505 for pushing off molds to selectively establish a fluid communication and a cutoff therebetween. The solenoid valve SV6 couples the compressed-air source 501 to a pattern-shuttling cylinder 506 to selectively establish a fluid communication and a cutoff therebetween. The solenoid valve SV7 couples the compressed-air source 501 to a cylinder 507 of a core flask to selectively establish a fluid communication and a cutoff therebetween. Further, the solenoid valve SV8 couples the compressed-air source 501 to a cylinder C of a lower filling frame to selectively establish a fluid communication and a cutoff therebetween.

These solenoid valves may be directly installed in, or installed independently from, the flaskless molding machine. The solenoid valves are electrically connected to a PLC (programmable controller), which is directly installed in, or installed independently from, the flaskless molding machine, via an electrical wiring system.

The PLC is also electrically connected to a control panel (or a touch panel), which is directly installed in, or installed independently from, the flaskless molding machine, via the electrical wiring system. The PLC and the control panel (or the touch panel) may be arranged in a single box, or arranged independently from each other.

During an operator's manual operation mode, an operational command entered in the control panel (or the touch panel) causes the PLC to provide an electrical signal to the corresponding solenoid valve, to activate it.

In an automated operation mode, the control panel (or the touch panel) provides automatic operational signals to the PLC such that the PLC transmits a sequence of operational commands to the respective solenoid valves under a sequence control to operate the flaskless molding machine, to make the molds.

Below the driving mechanism as illustrated in FIG. 18 will be explained. In FIG. 18, the control panel (not shown) incorporates a sequence control circuit (PLC) such that the flaskless molding machine operates in line with a sequence provided from the sequence control circuit.

Each of the solenoid valves SV5-SV8 is a 3 Position (3 Port) double-solenoid valve. When one solenoid SOL-A of the solenoid valve SV6 is actuated, the cylinder 6 is extended. When the other solenoid SOL-B of the solenoid valve SV6 is actuated, the cylinder 6 is contracted. The solenoid valve SV6 is configured so that it is stopped or operated in its neutral position when neither the solenoid SOL-A nor the solenoid SOL-B of the solenoid valve SV6 receives a command (or a command is interrupted), so as to maintain the cylinder 506 at a position where the command is interrupted.

Similarly, a driving signal is entered in one solenoid SOL-A of the solenoid to raise the cylinder 507 of the cope flask. (If the driving signal enters neither the solenoid SOL-A nor the other solenoid SOL-B, then both their piping is coupled to an exhaust such that the cylinder 507 is lowered by means of the cope flask's own weight.) Further, the solenoid valve 8 is configured to operate a cylinder C of the lower filling cylinder C. By combining the functions as described above of the driving mechanism, a squeezing mechanism squeezes the molding sand.

Furthermore, in the above embodiment, the solenoid valves SV5, SV6, SV7, and SV8 utilize pneumatic pressure, and are integrally coupled to the manifold Mh such that their installation, operation, and maintenance can be readily done. The manifold of the solenoid valves, utilizing pneumatic pressure, which is used with the driving mechanism to drive the flask-setting and squeezing cylinder, of the solenoid valves utilizing the pneumatic pressure to the setting flasks, may be integrally configured. In such a configuration, the installation, operation, and maintenance can be readily carried out. At least one cylinder may be an electric cylinder.

Although the step of squeezing the molding sand in this embodiment is also carried out by squeezing the molding sand from underneath, this step may be carried out by squeezing the molding sand from above.

5. The Molding Machine of the Third Embodiment

As described above, FIG. 18 is the side view of the molding machine of the third embodiment of the present invention and includes a partially front view. In reference to FIG. 18, now the molding machine of the third embodiment of the present invention is explained. However, the driving mechanism for the flask-setting and squeezing cylinder in the molding machine has already been explained in reference to FIG. 18.

In FIG. 18, a gantry frame F is configured such that a lower base frame 511 and an upper base frame 512 are integrally coupled to each other by columns 513, 513 in each of the four corners in the plan of the gantry frame F. The flask-setting and squeezing cylinder 514 is upwardly mounted on the central part of the upper surface of the lower base frame 511. The distal end of the piston rod 514*a* of the flask-setting and squeezing cylinder 514 is attached to a lower squeezing board 516 through a lower squeezing frame 515. Each of the four corners of the plan of the lower base frame 511 is provided with a slideable bushing, which is at least 10 mm high, such that the lower squeezing frame 515 maintains its horizontal position. Four cylinders C, C of a lower filling frame are mounted on the lower squeezing frame 515 such that they surround the flask-setting and squeezing cylinder 514. The respective distal ends of the piston rods Ca of the cylinders C are attached to a lower filling frame 517. The main body of the flask-setting and squeezing cylinder 514 is inserted through an insertion opening that is provided in the center of the lower squeezing frame 515 to place the flask-setting and squeezing cylinder 514.

The lower filling frame 517 is configured such that its inner face is formed as a diminishing taper such that the internal space in the lower filling frame 517 becomes narrower from top to bottom. Thus the lower squeezing board 516 can be tightly closed and hermetically inserted therein. The sidewalls of the lower filling frame 517 are provided with molding-sand introducing ports (not shown).

The lower squeezing board 516 is integrally configured with the lower squeezing frame 515. Therefore, in such a configuration, when the flask-setting and squeezing cylinder 514 ascends, then in turn the lower squeezing board 516 ascends with the four cylinders C, C of the filling lower frame, in which each cylinder C is mounted on the lower squeezing frame 515. The cylinders C, C of the lower filling frame are configured such that they can be raised independently from and simultaneously with the flask-setting and squeezing cylinder 514. That is, the filling frame 517 is attached to the respective distal ends of the piston rods Ca of the respective cylinders C, C that are upwardly mounted on the lower squeezing frame 515, which is vertically movably provided with two or more columns 513, 513, while a lower squeezing unit that comprises the lower squeezing board 516 and the lower squeezing frame 515 that are vertically and integrally movable is provided. Positioning pins 517*b* stand on the upper surface of the lower filling frame 517.

On the lower surface of the upper base frame 512, an upper squeezing board 518 is fixedly provided and is in an upper opposed position to the lower squeezing board 516. The cope flask 520 is configured such that its inner face is formed as a taper such that the internal space of the cope flask 520 becomes wider from top to bottom and thus the upper squeezing board 518 can be tightly closed and hermetically inserted therein. The sidewalls of the cope flask 520 are provided with molding-sand introducing ports. As illustrated in FIG. 18, on the upper base frame 512, a cylinder 507, which forms an air cylinder for the cope flask, is downwardly and fixedly mounted. The cope flask 520 is fixed to a piston rod 522*a* of the cylinder 507 such that it ascends by a contracting motion of the piston rod 522*a*.

In a location intermediate between the upper squeezing board 518 and the lower squeezing board 516, spacing is defined and maintained such that a drag flask 523 can be laterally passed through the spacing.

In an interval between the columns 513, 513, a square-bar shaped traveling rail R is arranged such that the drag flask 523 can be moved in a front-back direction in relation to the molding machine. On the upper surface of the drag flask 523, a matchplate 525, in which the patterns are provided on both surfaces, is arranged and mounted through a master plate 526. Each of the four corners of the master plate 526 is provided with a flanged roller 528 through a vertical roller arm 527. An aeration tank 529 has a leading end diverging in two directions to form sand-introducing ports 530. Provided above the aeration tank 529 is a sand gate 532 having a molding sand-supplying port (not shown).

Next a pneumatic piping system will be explained. As described above, the driving mechanism of the molding machine as illustrated in FIG. 18 includes the compressed-air source 501 on which the solenoid valves SV5-SV8, utilizing pneumatic pressure, are integrally coupled, through the manifold Mh. The solenoid valves SV5, SV6, SV7, and SV8 are coupled to the pushing-out cylinder 505, for pushing out the molds, the pattern-shuttling cylinder 506, the cylinder 507 of the cope flask, and the cylinder C of the lower filling frame, respectively, to selectively establish a fluid communications and cutoffs therebetween.

Below the operations of the flaskless molding machine of this embodiment will be explained. In FIG. 18, first, the pattern-shuttling cylinder 506, which is coupled to the compressed-air source to selectively establish the state of the fluid communication and the state of the cut-off therebetween, carries the master plate 526, which is mounted on a carriage in the molding station. In this case, the drag flask 523 has already been mounted on the lower part of the master plate 526.

To blow and thus fill the upper and lower molding spaces that are defined by stacking the cope flask 520 and the drag flask 523 with the molding sand without having it leak therefrom, the cope flask 520 and the drag flask 523 are in a tightly-closed relationship by operating the four cylinders C of the lower filling frame and the flask-setting and squeezing cylinder 514. In this operation, the required output power of the flask-setting and squeezing cylinder 514 is sufficient, if it corresponds to the objects to be lifted by the flask-setting and squeezing cylinder 514. Therefore, the hydraulic pressure to operate the flask-setting and squeezing cylinder 514 may be lowered.

The molding sand within the aeration tank 527 is blown and introduced into the cope flask 520, the drag flask 523, and the lower filling frame 517. The flask-setting and squeezing cylinder 514 then squeezes the filled molding sand, while operating fluid having a high pressure is supplied to the flask-setting squeezing cylinder 514 to make the molds with a predetermined hardness. As just described, the booting of the hydraulic pressure is carried out only when the output of high-pressure is necessary. The booster device can be made compact.

Now, the step of drawing the molds will be described. To strip the molds, the flask-setting and squeezing cylinder 514 is contracted and thus lowered to begin drawing an upper mold (not shown) in the cope flask 520. The flanged roller 528 of the carriage D, which is integrally constituted from the drag flask 523, the matchplate 525, the master plate 526, the roller arm 527, and the flanged roller 528, is then lowered to the level of a rail 533 such that the flanged roller 528 is picked up on the rail 533. After the drag flask 523 and the filling frame 517, tightly bound to each other, have been filled with the molding sand, squeezed, and integrally lowered by lowering the flask-setting and squeezing cylinder 514, the entire carriage D is transferred to the rail 533. Because the flask-setting and squeezing cylinder 514 is further lowered after the carriage D has been transferred to the rail 533, the drag flask 523 and the lower filling frame 517 are moved away from each other immediately after the carriage D has transferred to the rail 533. This motion begins the drawing of a lower mold (not shown) in the drag flask 523. When the contracting motion of the flask-setting and squeezing cylinder 514 is completed, the step of drawing the molds is completed.

The step of stacking the flasks will then be carried out. In this step, the pattern-shuttling cylinder 506 carries out the master plate 526 from the molding station. The flask-setting and squeezing cylinder 514 is extended to stack the upper mold and the lower mold such that they are in a tightly-closed relation with each other. Because at this time the raising power of the flask-setting and squeezing cylinder 514 is set less than that in the step of squeezing the molding sand, the molds can be prevented from collapsing.

The cylinder 507 of the cope flask 520 lifts up the flask to strip the upper mold therefrom.

The flask-setting and squeezing cylinder 514 is then contracted to locate it in a location where the cylinder 514 pushes out the molds. Further, the cylinder C of the lower filling frame 517 is contracted to strip the lower mold (not shown) from the lower filling frame 517. The upper and lower molds on the upper surface of the lower squeezing board 516 are pushed out to a side of a conveyor line by means of a pushing plate 505*a* for pushing out the molds.

As is obvious from the above description, in the flaskless molding machine of the third embodiment, a squeezing mechanism that is the same as that of the first embodiments is employed, and the air-on-oil system is applied on only the flask-setting and squeezing cylinder. Therefore, the embodiment can have an outputted power that equals the hydraulic power, by using only pneumatic pressure without using a dedicated hydraulic system having a hydraulic pump.

In addition, booster equipment can be made compact, since it boosts the pressure just when high-output power is necessary. Furthermore, because the molding process of this embodiment utilizes just one cutting-off valve, but utilizes no hydraulic unit having a hydraulic pump, the cost required to replace a component and to carry out maintenance can be reduced, and an operator needs just a little knowledge of hydraulic pressure and hydraulic equipment.

In the flaskless molding machine of the third embodiment, because the components for driving the flask-setting and squeezing cylinder 3 can be constructed as are those of the driving mechanism 500 (FIG. 17) of the second embodiment, these components can be operated by means of only a pneumatic control and a hydraulic control. The flaskless molding machine thus utilizes a hydraulic unit having a hydraulic pump such that installation, operations, and maintenance can be readily carried out.

In addition, using a manifold provides dedispersed pneumatic controllers that are organized and made compact so as to provide a benefit in which installation and maintenance can be readily carried out.

Further, in the flaskless molding machine of this embodiment, the cope flask may ascend and descend by means of an actuator during the step of stripping the flasks. In such an arrangement, a stroke step of stripping the flasks is increased such that the step of stripping the flasks can be steady achieved.

In the flaskless molding employing the mechanical structure in this embodiment, because the lower squeezing board 516 is integrally configured with the lower squeezing frame 515 that is vertically movably mounted on the four columns, the lower squeezing board 516 can be prevented from tilting during the step of squeezing the molding sand, even if the pattern is eccentrically located on the pattern plate 525. Thus, high-quality molds, each having a flat bottom surface, can be stably made. Further, because the lower filling frame 517 and the lower squeezing board 516 ascend and descend in unison, their constructions are simplified.

In addition, because no personnel are required to install piping and no personnel who specialize in hydraulic pressure are required to install and assemble the flaskless molding machine on site, the cost of installing it can also be reduced.

In this embodiment, although supplying the molding sand utilizes aeration, instead of it, blowing may be utilized. As used in this embodiment, the term "aeration" refers to a method for supplying the molding sand with pneumatic low-pressure, i.e., a range from 0.05 MPa to 0.18 MPa. In this embodiment, the term "blowing" refers to a method for supplying the molding sand with pneumatic high-pressure, i.e., a range from 0.2 MPa to 0.35 MPa.

The driving mechanism 500 in this embodiment may be configured such that it is replaced with the driving mechanism 400, which is described above in the first embodiment.

As described above, the driving mechanism of the molding equipment of the third embodiment can generate high power by just supplying pneumatic pressure, to provide a compact driving mechanism that can be readily maintained. That is, with this embodiment, using just pneumatic pressure, an outputted power that equals hydraulic pressure can be obtained without using a dedicated hydraulic unit. Booster equipment can be made compact, since it boosts the pressure just when high-output power is necessary. Furthermore, because the flask-less molding machine of this embodiment just utilizes one cut-off valve, and utilizes no hydraulic unit having a hydraulic pump, the cost required for replacement parts for maintenance can be reduced, and an operator needs little knowledge of hydraulic pressure or hydraulic equipment. In addition, because no piping-installation personnel who specialize in hydraulic pressure are required to install and assemble the flaskless molding machine on site, the cost of installing it can also be reduced.

Furthermore, the driving mechanism of this embodiment can operate sand-mold equipment by just supplying pneumatic pressure and electricity. In comparison to a hydraulic valve, a pneumatic valve is light, and can be readily handled. Because almost all the piping is also constituted from pneumatic piping, an operator can readily handle it when maintaining it. Further, the flaskless molding machine of this embodiment has an advantage over the above driving mechanism, which utilizes pneumatic pressure, and can drive and operate molding equipment by supplying just pneumatic pressure.

In addition, in Patent Literature 2 described above, a large cylinder reciprocates, to the right and left, from two to five times per second. In contrast, in this embodiment, supplying pressure to one side of the head of the booster cylinder generates high pressure. Therefore, this embodiment has a benefit, in that a high-pressure valve needs only a cutting-off valve.

In the driving mechanism in the sand molding equipment of this embodiment, the compressed-air source and the hydraulic-oil tank can be configured to establish a fluid communication and a cutoff therebetween by means of the first solenoid valve and the pneumatic valve that is connected to the upper portion of the hydraulic-oil tank. Such a configuration has a benefit in that the reciprocal motions of a piston that are necessary for Patent Literature 2 are reduced.

In the driving mechanism in the sand molding equipment of this embodiment, the compressed-air source and the flask-setting squeezing cylinder can be configured to establish a fluid communication and a cutoff therebetween by means of the third solenoid valve. Such a configuration has a benefit in that the return motion of the cylinder can be smoothly carried out.

Further, in the driving mechanism in the sand molding equipment of this embodiment, the compressed-air source and the booster cylinder can be configured to establish a fluid communication and a cutoff therebetween by means of the second solenoid valve such that both an intake port and an exhaust port are alternately in fluid communication and in a cutoff therebetween by activating a valve that is provided with each port, by using the second solenoid valve. Such a configuration has a benefit in that the reciprocal motions of a piston that are necessary as in Patent Literature 2 are reduced.

In the driving mechanism in the sand molding equipment of this embodiment, at least two of the first solenoid valve, the second solenoid valve, and the third solenoid valve can be integrally coupled by means of, for instance, a manifold. In such an arrangement, control positions for controlling the pneumatic pressures are dispersed such that the controller for controlling the driving mechanism can be made compact, to thereby provide a benefit in which installation and maintenance can be very readily carried out.

In the driving mechanism in the sand molding equipment of this embodiment, when the operation of the flask-setting and squeezing cylinder is interrupted, utilizing hydraulic pressure for the driving mechanism causes the cylinder to push out the molds. In such an arrangement, the cylinder for pushing out the molds is exclusively used to do so, and thus to provide a benefit in that the step of pushing out the molds is steadily carried out. The driving mechanism in the sand molding equipment of this embodiment may also include a pattern-shuttling cylinder that is in fluid communication with, or cut off from, the pneumatic source.

Further, if a manifold is provided, and if the solenoid valve and the pattern-shuttling cylinder fluidly communicate therebetween, control position for controlling pneumatic pressures form dedispersed positions such that the controller controlling the driving mechanism can be made compact, to provide a benefit in which installation and maintenance can be very readily done.

In addition, using a pressure switch to measure hydraulic pressure in hydraulic piping enables a check to be made on whether a specified hydraulic pressure remains such that a constant surface-pressure can be maintained in each molding cycle, to provide quality stabilities for the molds to be made.

Further, a speed controller may be provided between the cut-off valve in the hydraulic piping and a lower oil sump in the hydraulic oil tank. With such a configuration, the velocity for lowering the flask-setting and squeezing cylinder on which the drag flask is mounted in the step of drawing the molds can be adjusted to provide shock prevention when the molds are drawn.

Furthermore, the driving mechanism of the sand-molding equipment of this embodiment may also include a dedicated cylinder in the cope flask, to raise the cope flask when the flasks are stripped. Such a configuration has no use for a stopper pin such as is disclosed in Patent Literature 1, and thus has a benefit in that the construction of the squeezing mechanism can be simplified. Also, the stroke of the cylinder for drawing the flasks is increased such that the step of stripping the flasks can be steadily carried out.

Further, utilizing a manifold enables the control positions for controlling pneumatic pressures to form dedispersed positions such that the driving mechanism can be made compact, to provide a benefit in which the installation and maintenance can be very readily carried out.

The flaskless molding machine for simultaneously making a flaskless upper mold and a flaskless lower mold of this embodiment comprises a lower squeezing board that can be vertically moved by a flask-setting and squeezing cylinder; a lower filling frame, having sidewalls with sand-filling ports, that can be vertically moved simultaneously with and independently from a lower squeezing board by means of a plurality of cylinders of the lower filling frame; a lower squeezing unit that is configured so that it includes the lower squeezing board and the lower squeezing board such that they are coupled to the distal ends of the rods of the cylinders of the lower filling frame, wherein each cylinder of the lower filling frame is upwardly mounted on the lower squeezing frame such that the lower squeezing unit can be vertically moved along with the lower squeezing board and the lower squeezing frame in unison; an upper squeezing board that is fixed, located, and opposed to and above the lower squeezing board; a cope flask, having sidewalls with the sand-filling ports that is fixed on an upper frame and that can be vertically moved by a cylinder of the cope flask; a drag flask that is arranged such that it can be carried in and carried out of a location intermediate between the lower squeezing board and the upper squeezing board by means of a pattern-shuttling cylinder, wherein the drag flask is provided with a matchplate mounted thereon; and wherein the cylinder of the cope flask is fixed on the upper frame such that the contraction of its piston rod lifts up the cope flask; characterized in that the flask-setting and squeezing cylinder for driving the lower squeezing board is activated by the driving mechanism described above.

In the flaskless molding machine of this embodiment, the air-on-oil system used in the driving mechanism is applied to only the flask-setting and squeezing cylinder. By this configuration an output power can thus be obtained that equals that of hydraulic pressure by supplying solely pneumatic pressure, without using a dedicated hydraulic unit having a hydraulic pump. Further, booster equipment can be made compact, since it boosts the pressure just when high-output power is necessary. Furthermore, because the flaskless molding machine of this embodiment utilizes just one cutoff valve, but utilizes no hydraulic unit having a hydraulic pump at all, the cost required for replace parts during maintenance can be reduced, and an operator needs little knowledge of hydraulic pressure or hydraulic equipment. In addition, because no piping-installation personnel who specialize in hydraulic pressure are required to install and assemble the flaskless molding machine on site, the cost of its installation can also be reduced.

Further, in the flaskless molding machine of this embodiment, the cope flask may ascend and descend by means of an actuator during the step of stripping the flasks. In such an arrangement, the stroke length for striping the flasks is increased such that the step of stripping the flasks can be steadily achieved.

Nevertheless, it will be understood that various modifications may be made without departing from the spirit and scope of the invention. For example, some of the steps described herein may be independent of order, and thus can be performed in an order different from that described.

BRIEF DESCRIPTIONS OF REFERENCE SIGNS

2 Flask-setting and squeezing cylinder
4 Lower squeeze board
5 Cylinder of lower filling frame
6 Lower filling frame
6*c* Molding-sand introducing ports
8 Upper squeezing board
10 Cope flask
21 Pattern-shuttling cylinder
23 Drag flask
24 Matchplate
51 Molding sand
54 Upper mold (a mold)
55 Lower mold (a mold)
403 Booster cylinder (a pneumatic circuit and a hydraulic circuit)
PS Pressure switch (a sensor)
501 Compressed-air source
502 Hydraulic oil tank
Op Hydraulic piping
Ap Pneumatic piping
SV1 First solenoid valve
SV2 Second solenoid valve
SV3 Third solenoid valve
SV4-SV8 Solenoid valves
V1 First valve
V2*a* Second valve
503 Flask-setting and squeezing cylinder
504 Booster cylinder
Mh Manifold
505 Pushing out cylinder for pushing out the molds
506 Pattern shuttling cylinder
507 Cylinder of the cope flask
C Cylinder of a lower filling frame
512 Upper frame
513 Columns
515 Lower squeezing frame
516 Lower squeezing board
517 Lower filling frame
518 Upper squeezing board
520 Cope flask
523 Drag flask
525 Matchplate

The invention claimed is:

1. A molding machine for simultaneously making an upper mold and a lower mold, the machine comprising:

a drag flask that is arranged such that the drag flask can be carried in and carried out of a site in the machine adapted to make molds;

a matchplate mounted on an upper surface of the drag flask and having patterns on under and upper surfaces thereof;

a lower filling frame that can be raised and lowered and having sidewalls with sand-filling ports, the lower filling frame being coupled to a lower end of the drag flask;

a lower squeezing board that can be raised and lowered to define a lower molding space together with the drag flask and the under surface of the matchplate;

an upper squeezing board that is fixed above and opposed to the matchplate;

a cope flask for defining an upper molding space together with the upper surface of the matchplate and the upper squeezing board;

a flask-setting and squeezing cylinder for raising and lowering the lower squeezing board;

a driving mechanism that includes a pneumatic piping system and a hydraulic piping system for driving the flask-setting and squeezing cylinder using an air-on-oil system; and a controller for controlling the driving mechanism, wherein:

a) upon the drag flask, the matchplate, the lower filling frame, and the lower squeezing board defining the lower molding space, while the matchplate, the upper squeezing board, and the cope flask define the upper molding space, the controller controls the driving mechanism to drive the flask-setting and squeezing cylinder at a low pressure;

b) upon the lower squeezing board being raised to squeeze molding sand in the cope flask and the drag flask for simultaneously making an upper mold and a lower mold, the controller controls the driving mechanism to drive the flask-setting and squeezing cylinder at a high pressure that is increased by means of a booster cylinder; and c) upon the upper mold being removed from the pattern on the upper surface of the matchplate, while the lower mold is being removed from the pattern on the under surface of the matchplate, the controller controls the booster cylinder to stop the booster cylinder and to drive the flask-setting and squeezing cylinder at a low pressure to descend the lower squeezing board; and wherein the controller controls the driving of the flask-setting and squeezing cylinder at the low pressure to remove molds to lower the lower squeezing board such that the drag flask, the matchplate, and the lower filling frame are lowered to remove the upper mold, while they are engaged with a pair of travelling rails for stooping the lowering of the drag flask and the matchplate in a middle of the lowering movement thereof, thereby the lowering of the lower squeezing board and the lower filling frame being able to continue to remove the lower mold.

2. The machine of claim 1, wherein a pressure switch is provided in the hydraulic piping system of the driving mechanism, to determine a timing to stop the booster cylinder, wherein upon the lower squeezing board being raised the lower squeezing board squeezes the molding sand to simultaneously make the upper mold and the lower mold.

3. The molding machine of claim 1, wherein control of the controller is carried out such that the flask-setting and squeezing cylinder is raised to stack the molds at low pressure due to the booster cylinder still being stopped, after the upper mold is drawn from the pattern on the upper surface of the matchplate, while the lower mold is drawn from the pattern on the lower surface of the matchplate.

4. The molding machine of claim 3, wherein after the molds are stacked control of the controller is carried out such that the upper mold is stripped from the cope flask, while the lower mold is stripped from the lower filling frame by allowing the flask-setting and squeezing cylinder to lower at the low pressure due to the fact that the booster cylinder is still being stopped.

5. The molding machine of claim 4, wherein the low pressure is in a range from 0.1 MPa to 0.6 MPa.

6. The molding machine of claim 5, wherein a pressure switch determines the timing to stop the booster cylinder, upon the pressure switch detecting that hydraulic pressure in the hydraulic piping system is at a range from 0.1 MPa to 21 MPa.

7. The molding machine of claim 6, wherein motions of the matchplate are carried out by a pattern-shuttling cylinder, the pattern-shuttling cylinder being operated by pneumatic pressure in a range from 0.1 MPa to 0.6 MPa.

8. The molding machine of claim 6, wherein motions of the matchplate are carried out by an electrical cylinder.

9. The molding machine of claim 8, wherein a cylinder of the lower filling frame is operated by pneumatic pressure in a range from 0.1 MPa to 0.6 MPa.

10. The molding machine of claim 1, wherein the driving mechanism includes a compressed-air source and a hydraulic oil tank in which one end is coupled to the compressed-air source to establish a fluid communication and a cutoff therebetween;

the flask-setting and squeezing cylinder having a return port that is coupled to the compressed-air source to establish a fluid communication and a cutoff therebetween and an inlet port that is coupled to the hydraulic oil tank to establish a fluid communication and a cutoff therebetween via the hydraulic piping system; and the booster cylinder having an inlet port and a return port, each port being coupled to the compressed-air source to establish a fluid communication and a cutoff therebetween, wherein the booster cylinder is coupled to the hydraulic oil tank to establish a fluid communication therebetween, and wherein the booster cylinder is coupled to the flask-setting and squeezing cylinder to establish a normal fluid communication therebetween via the hydraulic piping system.

11. The molding machine of claim 10, wherein the compressed-air source and the hydraulic-oil tank establish a fluid communication and a cutoff therebetween via a first solenoid valve and a first valve;

the compressed-air source and the booster cylinder establish a fluid communication and a cutoff therebetween via a second solenoid valve;

each of the inlet port and the return port of the booster cylinder being provided with a second valve that is driven by the second solenoid valve to alternately establish a fluid communication and a cutoff between the inlet port and the return port; and the compressed-air source and the flask-setting and squeezing cylinder establish a fluid communication and a cutoff therebetween via a third solenoid valve.

12. The molding machine of claim 11, wherein at least two of the first solenoid valve, the second solenoid valve, and the third solenoid valve are integrally coupled to one another through a manifold.

13. The molding machine of claim 12, wherein the compressed-air source is coupled to one or more cylinders of a pushing-out cylinder for pushing out the molds, the pattern-shuttling cylinder, cylinder of the cope flask, and a cylinder of the lower filling frame, to establish a fluid communication and a cutoff therebetween.

14. A molding process for simultaneously making an upper mold and a lower mold, the process comprising the steps of:

defining an upper molding space and a lower molding space, wherein the lower molding space is defined by a drag flask that is arranged to be carried into and carried out from a site adapted to make molds, a matchplate mounted on an upper surface of the drag flask and having patterns on both surfaces thereof, a lower filling frame to be raised and lowered, having sidewalls with sand-filling ports, being coupled to a lower end of the drag flask to raise and lower the lower filling frame, and a lower squeezing board to be raised and lowered, while the upper molding space is defined by an upper squeezing board that is fixed above and opposite to the matchplate and a cope flask;

introducing molding sand to the upper molding space and the lower molding space at the same time;

simultaneously making the upper mold and the lower mold by allowing the lower squeezing board to squeeze the molding sand;

removing the upper mold from the pattern on an upper surface of the matchplate, while removing the lower mold from the pattern on an under surface of the matchplate; and stripping the upper mold from the cope flask, while stripping the lower mold from the drag flask; wherein in the step of defining the upper and lower molding spaces, the lower molding space is defined by using a driving mechanism based on an air-on-oil system to drive a flask-setting and squeezing cylinder for setting the cope and drag flasks and squeezing the molding sand, while the upper molding space is defined by operating the flask-setting and squeezing cylinder at a low pressure;

in the step of simultaneously making the upper mold and the lower mold squeezing the molding sand by operating the flask-setting and squeezing cylinder at a high pressure that is increased by a booster cylinder; and in the step of removing the upper mold from the pattern, stopping the booster cylinder and driving the flask-setting and squeezing cylinder at a low pressure to cause the descent of the lower squeezing board to cause the descent of the drag flask, the matchplate, and the lower filling frame to remove the upper mold, and stopping the descent of the drag flask and the matchplate in a middle of the descent movement thereof by means of a pair of travelling rails, while the descent of the lower squeezing board and the lower filling frame is continued, so as to remove the lower mold.

* * * * *